US006179988B1

(12) United States Patent
Peckham et al.

(10) Patent No.: US 6,179,988 B1
(45) Date of Patent: Jan. 30, 2001

(54) PROCESS FOR MAKING COPPER WIRE

(75) Inventors: Peter Peckham, Painesville Township; Craig J. Hasegawa, Willoughby, both of OH (US)

(73) Assignee: ElectroCopper Products Limited, Mesa, AR (US)

( * ) Notice: Under 35 U.S.C. 154(b), the term of this patent shall be extended for 0 days.

(21) Appl. No.: 08/921,301

(22) Filed: Aug. 29, 1997

(51) Int. Cl.[7] ..... C25C 1/12

(52) U.S. Cl. ..... 205/580; 205/581; 205/582; 205/583; 205/584; 205/220; 205/221

(58) Field of Search ..... 205/220–221, 205/580–584, 222, 223, 50, 76, 77; 75/275, 324, 371

(56) References Cited

U.S. PATENT DOCUMENTS

| | | | |
|---|---|---|---|
| 440,548 | 11/1890 | Elmore . | |
| 622,906 | 4/1899 | Watson . | |
| 1,701,889 | 2/1929 | Junker . | |
| 2,285,308 | 6/1942 | Specht . | |
| 3,262,182 | 7/1966 | Duret et al. . | |
| 3,355,971 | 12/1967 | Vigor . | |
| 3,363,297 | 1/1968 | Snyder . | |
| 3,460,366 | 8/1969 | Musial et al. . | |
| 3,603,186 | 9/1971 | Vigor . | |
| 3,755,112 | 8/1973 | Fountain et al. | 204/108 |
| 3,853,724 | 12/1974 | Wojcik et al. | 204/108 |
| 3,875,779 | 4/1975 | Pugh et al. | 72/69 |
| 3,876,516 | 4/1975 | Pace et al. | 204/108 |
| 3,920,044 | 11/1975 | Gruner | 137/625.3 |
| 3,937,657 | 2/1976 | Parker et al. | 204/108 |
| 4,030,990 | 6/1977 | Piret et al. | 204/108 |
| 4,066,520 | 1/1978 | Emmett, Jr. et al. | 204/108 |
| 4,070,739 | 1/1978 | Hague et al. | 29/18 |
| 4,075,747 | 2/1978 | Hague et al. | 29/18 |
| 4,085,496 | 4/1978 | Malkani et al. | 29/527.2 |
| 4,171,973 * | 10/1979 | Hara et al. | 75/237 |
| 4,213,231 | 7/1980 | Middlemiss et al. | 29/18 |
| 4,274,315 | 6/1981 | Varner | 82/47 |
| 4,315,776 | 2/1982 | Pitler | 75/208 |
| 4,321,846 | 3/1982 | Neamtu | 82/36 |
| 4,389,868 | 6/1983 | Strout | 72/132 |
| 4,484,990 | 11/1984 | Bultman et al. | 204/106 |
| 4,771,519 | 9/1988 | Strout | 29/18 |
| 4,789,438 | 12/1988 | Polan | 204/13 |
| 4,916,989 | 4/1990 | Brown | 82/48 |
| 4,956,053 | 9/1990 | Polan et al. | 204/13 |
| 5,181,770 | 1/1993 | Brock et al. | 205/77 |
| 5,366,612 | 11/1994 | Clouser et al. | 205/73 |
| 5,403,465 | 4/1995 | Apperson et al. | 205/77 |
| 5,431,803 | 7/1995 | DiFranco et al. | 205/50 |
| 5,458,746 | 10/1995 | Burgess et al. | 204/106 |
| 5,516,408 | 5/1996 | Peckham et al. | 205/580 |
| 5,670,033 | 9/1997 | Burgess et al. | 205/74 |
| 5,679,232 | 10/1997 | Fedor et al. | 205/77 |

FOREIGN PATENT DOCUMENTS

| | | |
|---|---|---|
| 2001570 | 2/1979 | (GB) . |
| 2055067 | 2/1981 | (GB) . |
| 9700339 | 1/1997 | (WO) . |

OTHER PUBLICATIONS

PCT International Search Report, PCT/US98/12486, International filing date Jun. 16, 1998.

E.M. Trent, Metal Cutting, Butterworth & Co., Ltd., 1977, p. 28, 29, 38–41 and 60–69.

* cited by examiner

*Primary Examiner*—Kathryn Gorgos
*Assistant Examiner*—Wesley A. Nicolas
(74) *Attorney, Agent, or Firm*—Renner, Otto, Boisselle & Sklar, LLP

(57) ABSTRACT

This invention relates to a process for making wire, comprising: (A) forming a circular disk of electrodeposited copper, (B) rotating said disk about its center axis; (C) feeding a cutting tool into the peripheral edge of said disk to cause a strip of copper to peel from said disk; and (D) slitting said strip of copper to form a plurality of strands of copper wire.

54 Claims, 6 Drawing Sheets

PROCESS FOR MAKING COPPER WIRE

TECHNICAL FIELD

This invention relates to a process for making copper wire. More particularly, this invention relates to a process for making copper wire that includes the steps of forming a circular disk of electrodeposited copper, peeling a thin strip of copper from the peripheral edge of the disk, and slitting the strip of copper to form strands of copper wire.

BACKGROUND OF THE INVENTION

Conventional methods for making copper wire involve the following steps. Electrolytic copper (electrorefined, electrowon, or both) is melted, cast into bar shape, and hot rolled into a rod shape. The rod is then cold-worked as it is passed through drawing dies that systematically reduce the diameter while elongating the wire. In a typical operation, a rod manufacturer casts the molten electrolytic copper into a bar having a cross section that is substantially trapazoidal in shape with rounded edges and a cross sectional area of about 7 square inches. This bar is passed through a preparation stage to trim the corners, and then through 12 rolling stands from which it exits in the form of a 0.3125" diameter copper rod. The copper rod is then reduced to a desired wire size through standard drawing dies. Typically, these reductions occur in a series of dies with a final annealing step and in some instances intermediate annealing steps to soften the worked wire.

The conventional method of copper wire production consumes significant amounts of energy and requires extensive labor and capital costs. The melting, casting and hot rolling operations subject the product to oxidation and potential contamination from foreign materials, such as refractory and roll materials, which can subsequently cause problems to wire drawers which include wire breaks during drawing.

By virtue of the inventive process, copper wire is produced in a simplified and less costly manner when compared to the prior art. The inventive process utilizes electrodeposited cathodic copper as the copper source, and thus does not require use of the prior art steps of melting, casting and hot rolling to provide a copper rod feedstock.

U.S. Pat. No. 440,548 discloses a method for making wire which comprises electrodepositing a shell or cylinder of copper on a core, mold or mandrel; removing the deposited copper from the core, mold or mandrel using thermal expansion/contraction, or the rotary motion of a lathe coupled with the pressing movement of a roller; mounting the removed shell or cylinder of deposited copper in a machine for the purpose of cutting the shell or cylinder circumferentially into a continuous strip or rod; and drawing the strip or rod to form wire.

U.S. Pat. No. 4,771,519 discloses an apparatus for manufacturing a thin metal strip from a cylindrical metal workpiece that includes a rotatable workpiece support structure for concentrically mounting the workpiece, drive means for rotating the workpiece about its axis, holder means for supporting a cutting tool adjacent the peripheral surface of the cylindrical workpiece on the workpiece support structure, a cutting tool secured in the holder means, the cutting tool having a sharpened edge that is defined in part by a rake face that has a length of less than one millimeter, feed means for advancing the sharpened edge of the cutting tool transversely of the axis of the workpiece to peel a continuous thin metal strip from the workpiece, strip tensioning means for subjecting the strip to tension as it is peeled from said workpiece, and strip direction control means between the cutting tool and the strip tensioning means for varying the strip exit angle of the tensioned strip relative to the rake face of the cutting tool as the strip is being peeled from the workpiece.

U.S. Pat. No. 5,516,408 discloses a process for making copper wire directly from a copper-bearing material, comprising: (A) contacting said copper-bearing material with an effective amount of at least one aqueous leaching solution to dissolve copper ions into said leaching solution and form a copper-rich aqueous leaching solution; (B) contacting said copper-rich aqueous leaching solution with an effective amount of at least one water-insoluble extractant to transfer copper ions from said copper-rich aqueous leaching solution to said extractant to form a copper-rich extractant and a copper-depleted aqueous leaching solution; (C) separating said copper-rich extractant from said copper-depleted aqueous leaching solution; (D) contacting said copper-rich extractant with an effective amount of at least one aqueous stripping solution to transfer copper ions from said extractant to said stripping solution to form a copper-rich stripping solution and a copper-depleted extractant; (E) separating said copper-rich stripping solution from said copper-depleted extractant; (F) flowing said copper-rich stripping solution between an anode and a cathode, and applying an effective amount of voltage across said anode and said cathode to deposit copper on said cathode; (G) removing said copper from said cathode; and (H) converting said removed copper from (G) to copper wire at a temperature below the melting point of said copper. In one embodiment the copper that is deposited on the cathode during (F) is in the form of copper foil, and the process includes (H-1) slitting the copper foil into a plurality of strands of copper wire and (H-2) shaping the strands of copper wire to provide said strands of copper wire with desired cross-sections. In one embodiment the copper that is deposited on the cathode during (F) is in the form of copper powder, and the process includes (H-1) extruding the copper powder to form copper rod or wire and (H-2) drawing the copper rod or wire to form copper wire with a desired cross-section. In one embodiment, during step (G) the copper while on said cathode is score cut to form a thin strand of copper which is then removed from the cathode, and during step (H) this thin strand of copper is shaped to form copper wire with a desired cross-section.

SUMMARY OF THE INVENTION

This invention relates to a process for making copper wire, comprising: (A) forming a circular disk of electrodeposited copper, (B) rotating said disk about its center axis; (C) feeding a cutting tool into the peripheral edge of said disk to cause a strip of copper to peel from said disk; and (D) slitting said strip of copper to form a plurality of strands of copper wire.

BRIEF DESCRIPTION OF THE DRAWINGS

In the annexed drawings, like references indicate like parts or features.

DESCRIPTION OF THE PREFERRED EMBODIMENTS

Figure 1:
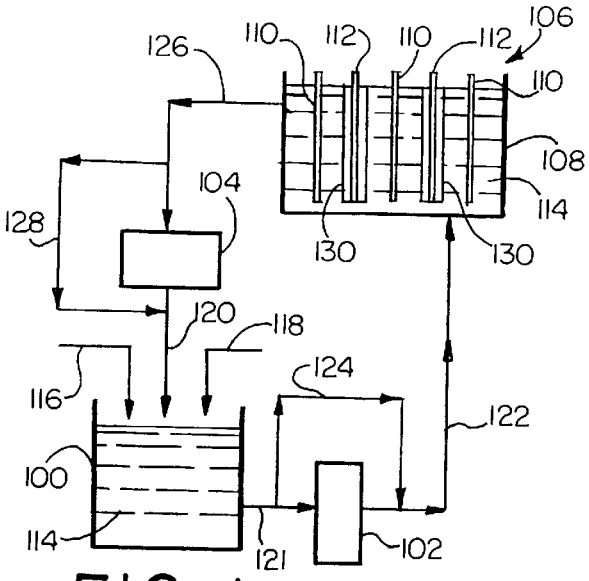
FIG. 1 is a flow sheet illustrating an electrodeposition process used to make the electrodeposited copper used with the inventive process.

The circular disk of copper, which is formed during step (A) of the inventive process, is made using electrodeposition. The circular disk typically has a thickness of about 0.1 to about 1 inch, and in one embodiment about 0.1 to about 0.5 inch, and in one embodiment about 0.2 to about 0.3 inch; and a diameter of up to about 60 inches, and in one embodiment about 4 to about 60 inches, and in one embodiment about 10 to about 40 inches, and in one embodiment about 24 to about 40 inches. In one embodiment, the circular disk is electrodeposited directly in the form of a circular disk.

In one embodiment, a square or rectangular plate is initially electrodeposited and then subsequently cut or shaped using known techniques (e.g., stamping, punching, machining, etc.) to form the circular disk. The plate typically has a thickness in the range of about 0.1 to about 1 inch, and in one embodiment about 0.1 to about 0.5 inch, and in one embodiment about 0.2 to about 0.3 inch; a length in the range of about 12 to about 60 inches, and in one embodiment about 24 to about 40 inches; and a width in the range of about 12 to about 60 inches, and in one embodiment about 24 to about 40 inches.

The circular disk typically has a copper content of at least about 96% by weight, and in one embodiment at least about 98% by weight, and in one embodiment at least about 99% by weight, and in one embodiment at least about 99.9% by weight, and in one embodiment at least about 99.99% by weight, and in one embodiment at least about 99.999% by weight. The density of the circular disk is typically in the range of up to about 8.96 grams per cubed centimeter (g/cc), and in one embodiment about 8.5 to about 8.96 g/cc, and in one embodiment about 8.7 to about 8.96 g/cc, and in one embodiment about 8.8 to about 8.96 g/cc, and in one embodiment about 8.9 to about 8.96 g/cc, and in one embodiment about 8.92 to about 8.96 g/cc. Since the circular disk, or the copper plate used to make the circular disk, is formed using electrodeposition, it is sometimes referred to as a copper cathode or cathodic copper.

Electrodeposition Process

In one embodiment, the circular disk of copper, or the copper plate used to make the circular disk, is formed using an electrodeposition process which employs as the copper feedstock any conventional copper feedstock used for electrodepositing copper, including copper shot, scrap copper metal, scrap copper wire, recycled copper, cupric oxide, cuprous oxide, and the like. In this embodiment, the circular disk, or the copper plate used to make the circular disk, is electrodeposited in an electroforming cell equipped with a series of cathodes and anodes. Typically the cathodes are vertically mounted and have flat surfaces. The cathodes can be circular in the form, or they can have square or rectangular shapes. The anodes are adjacent to the cathodes and are typically in the form of flat plates having the same shape as the cathodes. The gap between the cathodes and the anodes is typically from about 1 to about 10 centimeters, and in one embodiment about 2.5 to about 5 centimeters. In one embodiment, the anode is insoluble and made of lead, lead alloy, or titanium coated with a platinum family metal (i.e., Pt, Pd, Ir, Ru) or oxide thereof. The cathode has smooth surfaces on each side for receiving the electrodeposited copper and, in one embodiment, the surface is made of stainless steel, chrome plated stainless steel or titanium. The electrolyte solution is formed by dissolving the copper feedstock in sulfuric acid.

The electrolyte solution flows in the gaps between the anodes and cathodes, and an electric current is used to apply an effective amount of voltage across the anodes and the cathodes to deposit copper on the cathodes. The electric current can be a direct current or an alternating current with a direct current bias. The flow rate of the electrolyte solution through the gap between the anodes and the cathode is generally in the range of about 5 to about 60 gallons per minute (gpm), and in one embodiment about 20 to about 50 gpm, and in one embodiment about 30 to about 40 gpm. The electrolyte solution has a free sulfuric acid concentration generally in the range of about 10 to about 300 grams per liter, and in one embodiment about 60 to about 150 grams per liter, and in one embodiment about 70 to about 120 grams per liter. The temperature of the electrolyte solution in the electroforming cell is generally in the range of about 25° C. to about 100° C., and in one embodiment about 40° C. to about 60° C. The copper ion concentration is generally in the range of about 25 to about 125 grams per liter, and in one embodiment 60 to about 125 grams per liter, and in one embodiment about 70 to about 120 grams per liter, and in one embodiment about 90 to about 110 grams per liter. The free chloride ion concentration in the electrolyte solution is generally up to about 300 parts per million (ppm), and in one embodiment up to about 150 ppm, and in one embodiment up to about 100 ppm, and in one embodiment, up to about 20 ppm. In a particularly advantageous embodiment, the free chloride ion concentration is up to about 10 ppm, and in one embodiment up to about 5 ppm, and in one embodiment up to about 2 ppm, and in one embodiment up to about 1 ppm, and in one embodiment up to about 0.5 ppm, and in one embodiment up to about 0.2 ppm, and in one embodiment up to about 0.1 ppm, and in one embodiment it is zero or substantially zero. In one embodiment, the free chloride ion concentration is in the range of about 0.01 to about 10 ppm, and in one embodiment about 0.01 ppm to about 5 ppm, and in one embodiment about 0.01 ppm to about 2 ppm, and in one embodiment about 0.01 ppm to about 1 ppm, and in one embodiment about 0.01 ppm to about 0.5 ppm, and in one embodiment about 0.01 to about 0.1 ppm. The impurity level is generally at a level of no more than about 50 grams per liter, and in one embodiment no more than about 20 grams per liter, and in one embodiment no more than about 10 grams per liter. The current density is generally in the range of about 10 to about 100 amps per square foot (ASF), and in one embodiment about 10 to about 50 ASF.

During electrodeposition the electrolyte solution may optionally contain one or more active sulfur-containing materials. The term "active-sulfur containing material" refers to materials characterized generally as containing a bivalent sulfur atom both bonds of which are directly connected to a carbon atom together with one or more nitrogen atoms also directly connected to the carbon atom. In this group of compounds, the double bond may in some cases exist or alternate between the sulfur or nitrogen atom and the carbon atom. Thiourea is a useful active sulfur-containing material. The thioureas having the nucleus

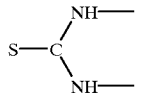

and the iso-thiocyanates having the grouping S═C═N— are useful. Thiosinamine (allyl thiourea) and thiosemicarbazide are also useful. The active sulfur-containing material should be soluble in the electrolyte solution and be compatible with the other constituents. The concentration of active sulfur-containing material in the electrolyte solution during electrodeposition is in one embodiment up to about 20 ppm, and in one embodiment in the range of about 0.1 to about 15 ppm.

The electrolyte solution may also optionally contain one or more gelatins. The gelatins that are useful herein are heterogeneous mixtures of water-soluble proteins derived from collagen. Animal glue is a preferred gelatin because it is relatively inexpensive, commercially available and convenient to handle. The concentration of gelatin in the electrolyte solution is generally up to about 20 ppm, and in one embodiment up to about 10 ppm, and in one embodiment in the range of about 0.1 to about 10 ppm.

The electrolyte solution may also optionally contain other organic additives known in the art for controlling the properties of the electrodeposited copper. Examples include saccharin, caffeine, molasses, guar gum, gum arabic, the polyalkylene glycols (e.g., polyethylene glycol, polypropylene glycol, polyisopropylene glycol, etc.), dithiothreitol, amino acids (e.g., proline, hydroxyproline, cysteine, etc.), acrylamide, sulfopropyl disulfide, tetraethylthiuram disulfide, benzyl chloride, epichlorohydrin, chlorohydroxylpropyl sulfonate, alkylene oxides (e.g., ethylene oxide, propylene oxide, etc.), the sulfonium alkane sulfonates, thiocarbamoyldisulfide, selenic acid, or a mixture of two or more thereof. In one embodiment, one or more of these organic additives are used in concentrations of up to about 20 ppm, and in one embodiment up to about 10 ppm.

In one embodiment, no organic additives are added to the electrolyte solution.

Referring now to FIG. 1, a process for electrodepositing copper plates used to make the circular disks pursuant to step (A) of the inventive process is disclosed. The apparatus used with this process includes a dissolution vessel 100, filters 102 and 104 and an electroforming cell 106. The electroforming cell 106 includes vessel 108, vertically mounted anodes 110, and vertically mounted cathodes 112. An electrolyte solution 114 is formed in dissolution vessel 100 by dissolving copper metal in sulfuric acid. The copper metal enters vessel 100, as indicated by directional arrow 116, in any conventional form which, as indicated above, includes copper shot, scrap copper metal, scrap copper wire, recycled copper, cupric oxide, cuprous oxide, and the like. The sulfuric acid entering vessel 100, as indicated by directional arrow 118, typically has a sulfuric acid concentration in the range of about 10 to about 300 grams per liter and in one embodiment about 60 to about 150 grams per liter. Electrolyte solution recycled from electroforming cell 106 also enters vessel 100 through line 120. The temperature of the electrolyte solution 114 in vessel 100 is typically in the range of about 25° C. to about 100° C., and in one embodiment about 40° C. to about 60° C. The copper feedstock is dissolved in the sulfuric acid and air to form the electrolyte solution 114. The electrolyte solution 114 is advanced from vessel 100 to vessel 108 through lines 121 and 122. The electrolyte solution 114 may be filtered in filter 102 prior to entering vessel 108 or, alternatively, it may by-pass filter 102 using line 124. The electrolyte solution 114 used in vessel 108 has the composition indicated above.

Figure 3:
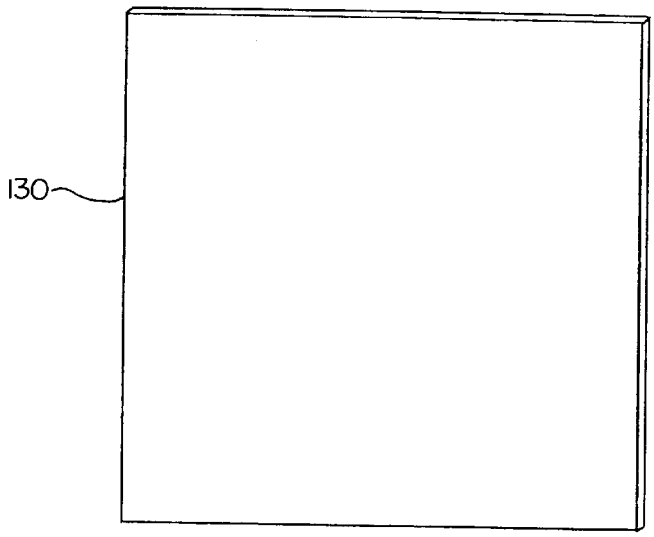
FIG. 3 is a schematic illustration of a copper plate used to make the circular disk of copper used with the inventive process.

The electrolyte solution 118 flows between the anodes 110 and cathodes 112 at a rate in the range of about 5 to about 60 gpm, and in one embodiment about 20 to about 50 gpm, and in one embodiment about 30 to about 40 gpm. A voltage is applied between anodes 110 and cathodes 112 to effect electrodeposition of copper plates 130 on the cathodes. In one embodiment, the current that is used is a direct current, and in one embodiment it is an alternating current with a direct current bias. The current density is in the range of about 10 to about 100 ASF, and in one embodiment about 10 to about 50 ASF. Copper ions in electrolyte 114 gain electrons at the surface of cathodes 112 whereby metallic copper deposits or plates out on each side of each of the cathodes 112. Electrodeposition of copper on cathodes 112 is continued until the thickness of the deposited copper plates 130 is at a desired level which typically is in the range about 0.1 to about 1 inch, and in one embodiment about 0.1 to about 0.5 inch, and in one embodiment about 0.2 to about 0.3 inch. Electrodeposition is then discontinued. The cathodes 112 are removed from the vessel 108. The deposited copper plates 130 are stripped from the cathodes 112 using known techniques, and then washed and dried. The deposited copper is typically in the form of a square or rectangular plate 130 as illustrated in FIG. 3. However, as indicated above, the deposited copper can be in the form of a circular disk.

The electrodeposition process depletes the electrolyte solution 114 of copper ions and, when used, organic additives. These ingredients are continuously replenished. Electrolyte solution 114 is withdrawn from vessel 108 through line 126 and recirculated through filter 104, line 120, dissolution vessel 100, line 121 and filter 102, and then is reintroduced into vessel 108 through line 122. Filter 104 may be by-passed through line 128. Similarly, filter 102 may be by-passed through line 124.

Organic additives may be added to the electrolyte solution 114 in either vessel 100, vessel 108 or in line 122 prior to the entry of the electrolyte solution into vessel 108. The addition rate for these organic additives is, in one embodiment, in the range of up to about 30 mg/min/kA, and in one embodiment about 0.1 to about 20 mg/mi/kA, and in one embodiment about 2 to about 20 mg/min/kA. In one embodiment, no organic additives are added.

The following examples are provided for purposes of illustrating the invention. Unless otherwise indicated, in the following example as well as throughout the specification and claims, all parts and percentages are by weight, all temperatures are in degrees Celsius, and all pressures are atmospheric.

EXAMPLE 1

A copper plate having the dimensions of 24×24×¼ inches is made using an electroforming cell of the type illustrated in FIG. 1. The electrolyte solution has a copper ion concentration of 50 grams per liter, and a sulfuric acid concentration of 80 grams per liter. The free chloride ion concentration is not detectable and no organic additives are added to the electrolyte.

EXAMPLE 2

A copper plate having the dimensions of 24×24×¼ inches is made using an electroforming cell of the type illustrated in FIG. 1. The electrolyte solution has a copper ion concentration of 93 grams per liter, and a free sulfuric acid concentration of 80 grams per liter. The free chloride ion concentration is in the range of 0.03–0.05 ppm. The temperature of the electrolyte solution is 54.4° C. and the current density is 30 ASF. Animal glue is added to the electrolyte solution at a rate of 9 mg/min/kA.

EXAMPLE 3

A copper plate having the dimensions of 24×24×¼ inches is made using an electroforming cell of the type illustrated in FIG. 1. The electrolyte solution has a copper ion concentration of 100 grams per liter, and a free sulfuric acid concentration of 80 grams per liter. The free chloride ion concentration is in the range of 70–90 ppm. The temperature of the electrolyte solution is 60° C. and the current density is 29 ASF. Animal glue is added to the electrolyte solution at a rate of 4 mg/min/kA.

EXAMPLE 4

A copper plate having the dimensions of 24×24×¼ inches is made using an electroforming cell of the type illustrated in FIG. 1. The electrolyte solution has a copper ion concentration of 100 grams per liter, and a free sulfuric acid concentration of 80 grams per liter. The free chloride ion concentration is in the range of 70–90 ppm. The temperature of the electrolyte solution is 58° C. and the current density is 30 ASF. Animal glue is added to the electrolyte solution at a rate of 0.4 mg/min/kA.

EXAMPLE 5

A copper plate having the dimensions of 24×24×¼ inches is made using an electroforming cell of the type illustrated in FIG. 1. The electrolyte solution has a copper ion concentration of 100 grams per liter, and a free sulfuric acid concentration of 80 grams per liter. The free chloride ion concentration is in the range of 2–5 ppm. The temperature of the electrolyte solution is 57° C. and the current density is 20 ASF. Animal glue is added to the electrolyte solution at a rate of 2.1 mg/min/kA.

EXAMPLE 6

A copper plate having the dimensions of 24×24×¼ inches is made using an electroforming cell of the type illustrated in FIG. 1. The electrolyte solution has a copper ion concentration of 105 grams per liter, and a free sulfuric acid concentration of 80 grams per liter. The free chloride ion concentration is less than 0.1 ppm. The temperature of the electrolyte solution is 57° C. and the current density is 24 ASF. Animal glue is added to the electrolyte solution at a rate of 0.07 mg/min/kA.

EXAMPLE 7

A copper plate having the dimensions of 24×24×¼ inches is made using an electroforming cell of the type illustrated in FIG. 1. The electrolyte solution has a copper ion concentration of 103 grams per liter, and a free sulfuric acid concentration of 60 grams per liter. The free chloride ion concentration is 2.8 ppm. The temperature of the electrolyte solution is 66° C. and the current density is 24 ASF. No organic additives are added.

EXAMPLE 8

A copper plate having the dimensions of 24×24×¼ inches is made using an electroforming cell of the type illustrated in FIG. 1. The electrolyte solution has a copper ion concentration of 103 grams per liter, and a free sulfuric acid concentration of 60 grams per liter. The free chloride ion concentration is 2.8 ppm. The temperature of the electrolyte solution is 60° C. and the current density is 20 ASF. No organic additives are added.

Solvent Extraction/Electrodeposition Process

In one embodiment, the circular disk of copper, or the copper plate used to make the circular disk, is formed in a process using solvent extraction in combination with electrodeposition. In this embodiment, the copper feedstock is any copper-bearing material from which copper may be extracted. These feedstocks include copper ore, smelter flue dust, copper cement, copper concentrates, copper smelter products, copper sulfate, and copper-containing waste. The term "copper-containing waste" refers to any solid or liquid waste material (e.g., garbage, sludge, effluent streams, etc.) that contains copper. These waste materials include hazardous wastes. Specific examples of wastes that can be used are copper oxides obtained from treating spent cupric chloride etchants.

The copper ore can be ore taken from an open pit mine. The ore is hauled to a heap-leaching dump which is typically built on an area underlain with a liner, such as a thick high-density polyethylene liner, to prevent loss of leaching fluids into the surrounding water shed. A typical heap-leaching dump has a surface area of, for example, about 125,000 square feet and contains approximately 110,000 tons of ore. As leaching progresses and new dumps are built on top of the old dumps, they become increasingly higher and eventually reach heights of, for example, about 250 feet or more. A network of pipes and wobbler sprinklers is laid on the surface of a newly completed dump and a weak solution of sulfuric acid is continuously sprayed at a rate of, for example, about 0.8 gallon per minute per 100 square feet of surface area. The leaching solution percolates down through the dump, dissolves copper in the ore, flows from the dump base as a copper-rich aqueous leach solution, drains into a collection pond, and is pumped to a feed pond for subsequent treatment using the inventive process.

With some mining operations in-situ leaching is used to extract copper values from copper ore. The copper-rich leach solution obtained by this process can be used in the inventive process as the copper-bearing material. In-situ leaching is useful when reserves of acid-soluble oxide ore lie beneath an open pit area and above the depleted portion of an underground mine or when a deposit is buried too deeply to be economically developed by open pit methods. Injection wells are drilled into this zone at a depth of, for example, about 1000 feet. The wells are cased with polyvinylchloride pipe, the bottom portion of which is slotted to allow solution into the ore. A leach solution of weak sulfuric acid is injected into each well at a rate dependent upon the permeability of the zone into which it is drilled. The solution percolates down through the ore zone, dissolves the copper minerals, and drains into a prepared collection area. The collection area can be, for example, haulage drifts of the underground mine. The copper-bearing aqueous leach solution that is produced is pumped to the surface by means of a corrosion-resistant pumping system where it is available for use as the copper-bearing material for the inventive process.

In mining operations wherein both leach dumps and in-situ leaching are employed, the copper-bearing leach solution (sometimes referred to as a pregnant leach solution) from each can be combined and used as the copper-bearing material in the inventive process.

In this embodiment, the circular disk of copper, or the copper plate used to make the circular disk, is made by the steps of: (A-1) contacting the copper-bearing material with an effective amount of at least one aqueous leaching solution to dissolve copper ions into said leaching solution and form a copper-rich aqueous leaching solution; (A-2) contacting the copper-rich aqueous leaching solution with an effective amount of at least one water-insoluble extractant to transfer copper ions from said copper-rich aqueous leaching solution to said extractant to form a copper-rich extractant and a copper-depleted aqueous leaching solution; (A-3) separating the copper-rich extractant from the copper-depleted aqueous leaching solution; (A-4) contacting the copper-rich extractant with an effective amount of at least one aqueous stripping solution to transfer copper ions from said extractant to said stripping solution to form a copper-rich stripping solution and a copper-depleted extractant; (A-5) separating the copper-rich stripping solution from the copper-depleted extractant; (A-6) flowing the copper-rich stripping solution between an anode and a cathode, and applying an effective amount of voltage across the anode and the cathode to deposit copper on the cathode; and (A-7) removing the copper from the cathode, the removed copper being the desired circular disk of copper or the desired copper plate.

The aqueous leaching solution used in step (A-1) of the inventive process is, in one embodiment, a sulfuric acid solution, halide acid solution (HCl, HF, HBr, etc.) or an ammonia solution. The sulfuric or halide acid solution generally has a sulfuric or halide acid concentration in the range of about 5 to about 50 grams per liter, and in one embodiment about 5 to about 40 grams per liter, and in one embodiment about 10 to about 30 grams per liter.

The ammonia solution generally has an ammonia concentration in the range of about 20 to about 140 grams per liter, and in one embodiment about 30 to about 90 grams per liter. The pH of this solution is generally in the range of about 7 to about 11, and in one embodiment about 8 to about 9.

The copper-rich aqueous leaching solution or pregnant leaching solution formed during step (A-1) generally has a copper ion concentration in the range of about 0.8 to about 5 grams per liter, and in one embodiment about 1 to about 3 grams per liter. When the leaching solution used in step (A-1) is a sulfuric acid solution, the concentration of free sulfuric acid in the copper-rich aqueous leaching solution is generally from about 5 to about 30 grams per liter, and in one embodiment about 10 to about 20 grams per liter. When the leaching solution used in step (A-1) is an ammonia solution, the concentration of free ammonia in the copper-rich aqueous leaching solution is generally from about 10 to about 130 grams per liter, and in one embodiment about 30 to about 90 grams per liter.

The water-insoluble extractant used in step (A-2) can be any water-insoluble extractant capable of extracting copper ions from an aqueous medium. In one embodiment the extractant is dissolved in a water-immiscible organic solvent. (The terms "water-immiscible" and "water-insoluble" refer to compositions that are not soluble in water above a level of about 1 gram per liter at 25° C.) The solvent can be any water-immiscible solvent for the extractant with kerosene, benzene, toluene, xylene, naphthalene, fuel oil, diesel fuel and the like being useful, and with kerosene being preferred. Examples of useful kerosenes are SX-7 and SX-12 which are available from Phillips Petroleum.

In one embodiment the extractant is an organic compound containing at least two functional groups attached to different carbon atoms of a hydrocarbon linkage, one of the functional groups being —OH and the other of said functional groups being =NOH. These compounds can be referred to as oximes. In one embodiment the extractant is an oxime represented by the formula

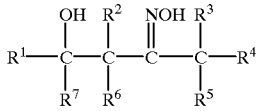

wherein $R^1$, $R^2$, $R^3$, $R^4$, $R^5$, $R^6$ and $R^7$ are independently hydrogen or hydrocarbyl groups. In one embodiment, $R^1$ and $R^4$ are each butyl; $R^2$, $R^3$ and $R^6$ are each hydrogen; and $R^5$ and $R^7$ are each ethyl. Compounds with this structure are available from Henkel Corporation under the trade designation LIX 63.

In one embodiment the extractant is an oxime represented by the formula

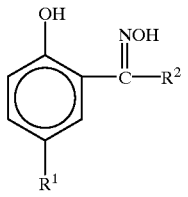

wherein $R^1$ and $R^2$ are independently hydrogen or hydrocarbyl groups. Useful embodiment include those wherein $R^1$ is an alkyl group of about 6 to about 20 carbon atoms, and in one embodiment about 9 to about 12 carbon atoms; and $R^2$ is hydrogen, an alkyl group of 1 to about 4 carbon atoms, and in one embodiment 1 or 2 carbon atoms, or $R^2$ is phenyl. The phenyl group can be substituted or unsubstituted with the latter being preferred. The following compounds, which are based upon the above-indicated formula, are available from Henkel Corporation under the trade designations indicated below and are useful with the inventive process:

| Trade Designation | $R^1$ | $R^2$ |
|---|---|---|
| LIX 65 | Nonyl | Phenyl |
| LIX 84 | Nonyl | Methyl |
| LIX 860 | Dodecyl | Hydrogen |

Other commercially available materials available from Henkel Corporation that are useful include: LIX 64N (identified as a mixture of LIX 65 and LIX 63); and LIX 864 and LIX 984 (identified as mixtures of LIX 860 and LIX 84).

In one embodiment the extractant is a betadiketone. These compounds can be represented by the formula

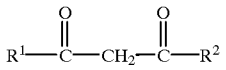

wherein $R^1$ and $R^2$ are independently alkyl groups or aryl groups. The alkyl groups generally contain 1 to about 10 carbon atoms. The aryl groups are generally phenyl. An example of a commercial extractant available from Henkel Corporation corresponding to the above formula is LIX 54. These betadiketones are useful when the leaching solution used in step (A-1) is an ammonia solution.

The concentration of the extractant in the organic solution is generally in the range of about 2% to about 40% by weight. In one embodiment the organic solution contains from about 5% to about 10%, or about 6% to about 8%, or about 7% by weight of LIX 984, with the remainder being SX-7.

In one embodiment the extractant is an ion-exchange resin. The resins are typically small granular or bead-like materials having of two principal parts: a resinous matrix serving as a structural portion, and an ion-active group serving as the functional portion. The functional group is generally selected from those functional groups that are reactive with copper ions. Examples of such functional groups include —$SO_3$—, —COO—,

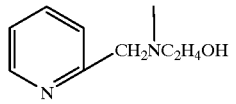

and

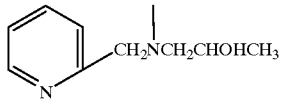

Useful resin matrixes include the copolymers of styrene and divinylbenzene. Examples of commercially available resins that can be used include IRC-718 (a product of Rohm & Haas identified as a tertiary amine substituted copolymer of styrene and divinylbenzene), IR-200 (a product of Rohm & Haas identified as sulfonated copolymer of styrene and divinylbenzene), IR-120 (a product of Rohm & Haas identified as sulfonated copolymer of styrene and divinylbenzene), XFS 4196 (a product of Dow identified as a macroporous polystyrene/divinylbenzene copolymer to which has been attached N-(2-hydroxyethyl)-picolylamine), and XFS 43084 (a product of Dow identified as a macroporous polystyrene/divinylbenzene copolymer to which has been attached N-(2-hydroxypropyl)-picolylamine). These resins are typically used in the inventive process as fixed beds or moving beds. During step (A-2) of the inventive process, the resin is contacted with the copper-rich aqueous leach solution from step (A-1), the contacting being sufficient to transfer copper ions from the leach solution to the resin. The copper-resin is then stripped during step (A-4) to provide a copper-stripped or copper-depleted resin which can be used during (A-2).

The copper-rich extractant that is separated during step (A-3) has a concentration of copper in the range of about 1 to about 6 grams per liter of extractant, and in one embodiment about 2 to about 4 grams per liter of extractant. The copper-depleted aqueous leaching solution that is separated during step (A-3) typically has a copper ion concentration in the range of about 0.01 to about 0.8 grams per liter, and in one embodiment about 0.04 to about 0.2 grams per liter. When the leaching solution used in step (A-1) is a sulfuric acid solution, the concentration of free sulfuric acid in the copper-depleted aqueous leaching solution separated during step (A-3) is generally from about 5 to about 50 grams per liter, and in one embodiment about 5 to about 40 grams per liter, and in one embodiment about 10 to about 30 grams per liter. When the leaching solution used in step (A-1) is an ammonia solution, the concentration of free ammonia in the copper-depleted aqueous leaching solution separated during step (A-3) is generally from about 10 to about 130 grams per liter, and in one embodiment about 30 to about 90 grams per liter.

In one embodiment the contacting and separating steps (A-2) and (A-3) are conducted in two stages. In this embodiment, steps (A-2-1) and (A-2-2) are contacting steps, and steps (A-3-1) and (A-3-2) are separating steps. Thus, in this embodiment, the inventive process involves the following sequence of steps: (A-1), (A-2-1), (A-3-1), (A-2-2), (A-3-2), (A-4), (A-5), (A-6) and (A-7) with process streams from several of these steps being recirculated to other steps in the process. Step (A-2-1) involves contacting the copper-rich aqueous leaching solution formed during step (A-1) with an effective amount of at least one copper-bearing water-insoluble extractant from step (A-3-2) to transfer copper ions from said copper-rich aqueous leaching solution to said copper-bearing extractant to form a copper-rich extractant and a first copper-depleted aqueous leaching solution. Step (A-3-1) involves separating the copper-rich extractant formed during step (A-2-1) from the first copper-depleted aqueous leaching solution formed during step (A-2-1). The copper-rich extractant that is separated during step (A-3-1) generally has a concentration of copper in the range of about 1 to about 6 grams per liter of extractant, and in one embodiment about 2 to about 4 grams per liter of extractant. The first copper-depleted aqueous leaching solution that is separated during step (A-3-1) generally has a copper ion concentration in the range of about 0.4 to about 4 grams per liter, and in one embodiment about 0.5 to about 2.4 grams per liter. When the leaching solution used in step (A-1) is a sulfuric acid solution, the concentration of free sulfuric acid in the first copper-depleted aqueous leaching solution separated during (A-3-1) is generally from about 5 to about 50 grams per liter, and in one embodiment about 5 to about 30 grams per liter, and in one embodiment about 10 to about 30 grams per liter. When the leaching solution used in (A-1) is an ammonia solution, the concentration of free ammonia in the first copper-depleted aqueous leaching solution separated during step (A-3-1) is generally from about 10 to about 130 grams per liter, and in one embodiment about 30 to about 90 grams per liter.

Step (A-2-2) involves contacting the first copper-depleted aqueous leaching solution separated during step (A-3-1)

with an effective amount of at least one copper-depleted extractant from step (A-5) to transfer copper ions from said first copper-depleted aqueous leaching solution to said copper-depleted extractant to form a copper-bearing extractant and a second copper-depleted aqueous leaching solution. Step (A-3-2) involves separating the copper-bearing extractant formed during step (A-2-2) from the second copper-depleted aqueous leaching solution formed during step (A-2-2). The copper-bearing extractant that is separated during step (A-3-2) generally has a concentration of copper in the range of about 0.4 to about 4 grams per liter of extractant, and in one embodiment about 1 to about 2.4 grams per liter of extractant. The second copper-depleted aqueous leaching solution that is separated during step (A-3-2) generally has a copper ion concentration in the range of about 0.01 to about 0.8 grams per liter, and in one embodiment about 0.04 to about 0.2 grams per liter. When the leaching solution used in step (A-1) is a sulfuric acid solution, the concentration of free sulfuric acid in the second copper-depleted aqueous leaching solution separated during step (A-3-2) is generally from about 5 to about 50 grams per liter, and in one embodiment about 5 to about 40 grams per liter, and in one embodiment about 10 to about 30 grams per liter. When the leaching solution used in step (A-1) is an ammonia solution, the concentration of free ammonia in the second copper-depleted aqueous leaching solution separated during step (A-3-2) is generally from about 10 to about 130 grams per liter, and in one embodiment about 30 to about 90 grams per liter.

the stripping solution used in step (A-4) of the inventive process is a sulfuric acid solution which has a free sulfuric acid concentration generally in the range of about 80 to about 300 grams per liter. In one embodiment, the free sulfuric acid concentration of the stripping solution used in (A-4) is about 80 to about 170 grams per liter, and in one embodiment about 90 to about 120 grams per liter.

The electrodeposition step (A-6) involves advancing the copper-rich stripping solution from step (A-5) into an electroforming cell and electrodepositing copper on the cathodes in the cell. The copper-rich stripping solution treated in the electroforming cell can be referred to as either a copper-rich stripping solution or an electrolyte solution. In one embodiment, this electrolyte solution is subjected to a purification or filtering process prior to entering the cell. The cell is operated in the same manner as the electroforming cell discussed above under the subtitle "Electrodeposition Process" with the result being the formation of the desired circular disks of copper, or the copper plates used to make such circular disks, on the cathodes of such cell. These circular disks or copper plates can be referred to as copper cathodes or cathodic copper.

The process will now be described with reference to FIG. 2, which is a flow sheet illustrating a solvent-extraction, electrodeposition process for making the copper plates that are used to make the circular disks required by the inventive process. In this process copper is extracted from copper leach dump 200 and treated in accordance with step (A) of the inventive process to produce the copper plates 130. The process involves the use of settlers 202, 204 and 206, collection pond 208, mixers 210, 212 and 214, dissolution vessel 100, electroforming cell 106, and filters 102, 104 and 216. In this embodiment, step (A-1) of the inventive process is conducted at the leach dump 200. Steps (A-2) and (A-3) are conducted in two stages using mixers 210 and 212, and settlers 202 and 204. Steps (A-4) and (A-5) are conducted using mixer 214 and settler 206. Steps (A-6) and (A-7) are conducted using electroforming cell 106.

An aqueous leach solution from line 220 is sprayed on the surface of leach dump 200. The leach solution is a sulfuric acid solution having a free sulfuric acid concentration generally in the range of about 5 to about 50, and in one embodiment about 5 to about 40, and in one embodiment about 10 to about 30 grams per liter. The leach solution percolates down through the dump and extracts copper from the ore. The leach solution flows through dump space 222 as a copper-rich aqueous leach solution (sometimes referred to as a pregnant leach solution), and through line 224 into collection pond 208. The leach solution is pumped from collection pond 208 through line 226 to mixer 212. The copper-rich leach solution that is pumped to mixer 212 has a copper ion concentration generally in the range of about 0.8 to about 5, and in one embodiment about 1 to about 3 grams per liter; and a free sulfuric acid concentration generally in the range of about 5 to about 30, and in one embodiment about 10 to about 20 grams per liter. In mixer 212, the copper-rich aqueous leach solution is mixed with a copper-bearing organic solution which is pumped into mixer 212 through line 228 from weir 230 of settler 204. The concentration of copper in the copper-bearing organic solution that is added to mixer 212 is generally from about 0.4 to about 4 grams per liter of extractant in the organic solution, and in one embodiment about 1 to about 2.4 grams per liter of extractant in the organic solution. During the mixing in mixer 212, an organic phase and an aqueous phase form and intermix. Copper ions transfer from the aqueous phase to the organic phase. The mixture is pumped from mixer 212 through line 232 to settler 202. In settler 202, the aqueous phase and organic phase separate with the organic phase forming the top layer and the aqueous phase forming the bottom layer. The organic phase collects in weir 234 and is pumped through line 236 to mixer 214. This organic phase is a copper-rich organic solution (which can be referred to as a loaded organic). This copper-rich organic solution generally has a copper concentration in the range of about 1 to about 6 grams per liter of extractant in the organic solution, and in one embodiment about 2 to about 4 grams per liter of extractant in the organic solution.

The copper-rich organic solution is mixed in mixer 214 with a copper-depleted stripping solution. The copper-depleted stripping solution (which can be referred to as a lean electrolyte) is produced in the electroforming cell 106 and is pumped from the cell 106 through line 238 to mixer 214. This copper-depleted stripping solution generally has a free sulfuric acid concentration in the range of about 80 to about 170, and in one embodiment about 90 to about 120 grams per liter; and a copper ion concentration in the range of generally about 40 to about 120, and in one embodiment about 80 to about 100, and in one embodiment about 90 to about 95 grams per liter. Fresh stripping solution make-up can be added to line 238 through line 240. The copper-rich organic solution and copper-depleted stripping solution are mixed in mixer 214 with the result being the formation of an organic phase intermixed with an aqueous phase. Copper ions transfer from the organic phase to the aqueous phase. The mixture is pumped from mixer 214 through line 242 to settler 206. In settler 206, the organic phase separates from the aqueous phase with the organic phase collecting in weir 244. This organic phase is a copper-depleted organic solution (which is sometimes referred to as a barren organic). This copper-depleted organic solution generally has a copper concentration in the range of about 0.5 to about 2 grams per liter of extractant in the organic solution, and in one embodiment about 0.9 to about 1.5 grams per liter of extractant in the organic solution. The copper depleted organic solution is pumped from settler 206 through line 246 to mixer 210. Fresh organic solution make-up can be added to line 246 through line 248.

Copper-containing aqueous leach solution is pumped from settler 202 through line 250 to mixer 210. This copper-containing aqueous leach solution has a copper ion concentration generally in the range of about 0.4 to about 4, and in one embodiment about 0.5 to about 2.4 grams per liter; and a free sulfuric acid concentration generally in the range of about 5 to about 50, and in one embodiment about 5 to about 30, and in one embodiment about 10 to about 20 grams per liter. In mixer 210, an organic phase and aqueous phase form, intermix and copper ions transfer from the aqueous phase to the organic phase. The mixture is pumped through line 252 to settler 204. In settler 204, the organic phase separates from the aqueous phase with the organic phase collecting in weir 230. This organic phase, which is a copper-containing organic solution, is pumped from settler 204 through line 228 to mixer 212. This copper-containing organic solution has a copper concentration generally in the range of about 0.5 to about 4 grams per liter of extractant in the organic solution, and in one embodiment about 1 to about 2.4 grams per liter of extractant in the organic solution. The aqueous phase in settler 204 is a copper-depleted aqueous leaching solution which is pumped through line 220, to the leach dump 200. Fresh leaching solution make-up can be added to line 220 from line 254.

The aqueous phase which separates out in settler 206 is a copper-rich stripping solution. It is pumped from settler 206 through line 260 to filter 216 and from filter 216 through line 262 and then either: through line 264 to electroforming cell 106; or through line 266 to filter 104 and from filter 104 through line 120 to dissolution vessel 100. Filter 216 can be by-passed through line 217. Similarly, filter 104 can be by-passed through line 128. This copper-rich stripping solution has a copper ion concentration generally in the range of about 50 to about 150 grams per liter, and in one embodiment about 90 to about 110 grams per liter; and a free sulfuric acid concentration generally in the range of about 70 to about 140, and in one embodiment about 80 to about 110 grams per liter. The copper-rich stripping solution entering electroforming cell 106 or dissolution vessel 100 can also be referred to as electrolyte solution 114. If the composition of the electrolyte solution requires adjustment (e.g., addition of organic additives, increase in copper ion concentration, etc.) the electrolyte solution is advanced to dissolution vessel 100 prior to being advanced to electroforming cell 106. If no adjustment in the composition of the electrolyte solution is required, the electrolyte solution is advanced directly to electroforming cell 106 through line 264. In electroforming cell 106, the electrolyte solution 114 flows between anodes 110 and cathodes 112. When voltage is applied between the anodes 110 and cathodes 112, electrodeposition of copper occurs at the cathode surface resulting in the formation of electrodeposited copper plates 130 on each side of each of the cathodes 112.

The electrolyte solution 114 is converted to a copper-depleted electrolyte solution in electroforming cell 106 and is withdrawn from cell 106 through either lines 268 or 238. The copper-depleted electrolyte solution in either line 238 or line 268 has a copper ion concentration generally in the range of about 40 to about 120 grams per liter, and in one embodiment about 80 to about 100 grams per liter, and in one embodiment about 90 to about 95 grams per liter; and a free sulfuric acid concentration generally in the range of about 80 to about 170 grams per liter, and in one embodiment about 90 to about 120 grams per liter. This copper-depleted electrolyte solution is either: (1) pumped through lines 268 and 266 to filter 104 (which optionally can be by-passed through line 128) and from filter 104 (or line 128) to line 120, through line 120 to dissolution vessel 100, and from vessel 100 through line 121 to filter 102, through filter 102 (which can be by-passed through line 124) to line 122 and back to cell 106; or (2) pumped through line 238 to mixer 214 as the copper-depleted stripping solution. Optionally, additional copper feedstock as indicated by directional arrow 116, sulfuric acid, as indicated by directional arrow 118, active-sulfur containing material, gelatin and/or other desirable additives of the type discussed above are added to the electrolyte solution in vessel 100. Also, impurities as well as chloride ions may be removed from the electrolyte solution 114 using either or both of filters 102 and 104.

The additional copper feedstock entering vessel 100, as indicated by directional arrow 116, can be in any conventional form which includes copper shot, scrap copper metal, scrap copper wire, recycled copper, cupric oxide, cuprous oxide, and the like. Additional sulfuric acid enters vessel 100 as indicated by directional arrow 118. Electrolyte solution 114 recycled from electroforming cell 106 also enters vessel 100 through line 120. The temperature of the electrolyte solution 114 in vessel 100 is typically in the range of about 25° C. to about 51° C., and in one embodiment about 32° C. to about 43° C. The electrolyte solution 114 is advanced from vessel 100 to vessel 108 through lines 121 and 122. The electrolyte solution 114 may be filtered in filter 102 prior to entering vessel 108 or, alternatively, it may pass through line 124 enroute to vessel 108 and thereby by-pass filter 102.

The electrolyte solution 114 advanced from vessel 100 to vessel 108 has a free sulfuric acid concentration generally in the range of about 10 to about 300 grams per liter, and in one embodiment about 60 to about 150 grams per liter, and in one embodiment about 70 to about 120 grams per liter. The copper ion concentration is generally in the range of about 25 to about 125 grams per liter, and in one embodiment about 60 to about 125 grams per liter, and in one embodiment about 70 to about 120 grams per liter, and in one embodiment about 90 to about 110 grams per liter. The free chloride ion concentration in the electrolyte solution is generally up to about 300 ppm, and in one embodiment up to about 150 ppm, and in one embodiment up to about 100 ppm, and in one embodiment up to about 20 ppm. In a particularly advantageous embodiment, the free chloride ion concentration is up to about 10 ppm, and in one embodiment up to about 5 ppm, and in one embodiment up to about 2 ppm, and in one embodiment up to about 1 ppm, and in one embodiment up to about 0.5 ppm, and in one embodiment up to about 0.2 ppm, and in one embodiment up to about 0.1 ppm, and in one embodiment it is zero or substantially zero. In one embodiment, the free chloride ion concentration is in the range of about 0.01 ppm to about 10 ppm, and in one embodiment about 0.01 ppm to about 5 ppm, and in one embodiment about 0.01 ppm to about 2 ppm, and in one embodiment about 0.01 ppm to about 1 ppm, and in one embodiment about 0.01 ppm to about 0.5 ppm, and in one embodiment about 0.01 to about 0.1 ppm. The impurity level is generally at a level of no more than about 50 grams per liter, and in one embodiment no more than about 20 grams per liter, and in one embodiment no more than about 10 per liter. The temperature of the electrolyte solution in vessel 108 is generally in the range of about 25° C. to about 100° C., and in one embodiment about 40° C. to about 60° C.

The electrolyte solution 114 flows between the anodes 110 and cathodes 112 at a velocity in the range of about 5 to about 60 gpm, and in one embodiment about 20 to about 50 gpm, and in one embodiment about 30 to about 40 gpm. A voltage is applied between anodes 110 and cathodes 112 to effect electrodeposition of the copper on the cathodes. In one embodiment, the current that is used is a direct current, and in one embodiment it is an alternating current with a direct current bias. The current density is in the range of about 10 to about 100 ASF, and in one embodiment about 10 to about 50 ASF. Copper ions in electrolyte 114 gain electrons at the surface of cathodes 112 whereby metallic copper plates out in the form of copper plates 130 on each side of each of the cathodes 112. Electrodeposition of copper on cathodes 112 is continued until the thickness of the copper plates 130 is at a desired level which may be, for example, about 0.1 to about 1 inch, and in one embodiment about 0.1 to about 0.5 inch, and in one embodiment about 0.2 to about 0.3 inch. Electrodeposition is then discontinued. The cathodes 112 are removed from the vessel 108. The copper plates 130 are stripped from the cathodes 112, and then washed and dried. The copper plates 130 are typically in the form of squares or rectangles as illustrated in FIG. 3. However, the copper plates 130 can be circular in form.

The electrodeposition process depletes the electrolyte solution 114 of copper ions and, when used, organic additives. These ingredients are continuously replenished. Electrolyte solution 114 is withdrawn from vessel 108 through line 268 and recirculated through filter 104, line 120, dissolution vessel 100, line 121 and filter 102, and then is reintroduced into vessel 108 through line 122. Filter 104 may be by-passed through line 128. Similarly, filter 102 may be by-passed through line 124.

Organic additives may be added to the electrolyte solution 114 in either vessel 100, vessel 108 or in line 122 prior to the entry of the electrolyte solution into vessel 108. The addition rate for these organic additives is, in one embodiment, in the range of up to about 30 mg/min/kA, and in one embodiment about 0.1 to about 20 mg/min/kA, and in one embodiment about 2 to about 20 mg/min/kA. In one embodiment, no organic additives are added.

EXAMPLE 9

Figure 2:
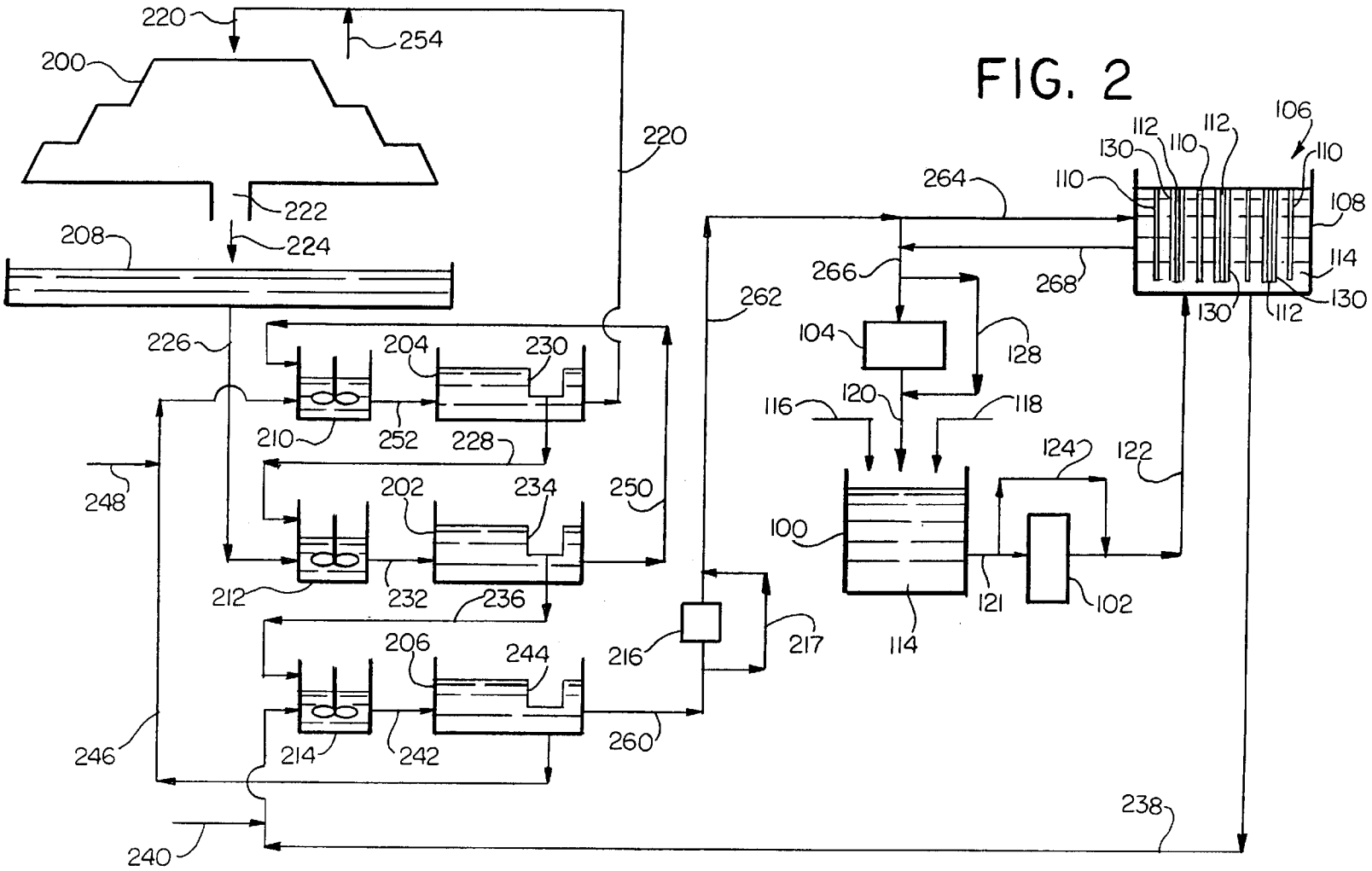
FIG. 2 is a flow sheet illustrating a solvent extraction, electrodeposition process used to make the electrodeposited copper used with the inventive process.

Copper plates 130 having the dimensions of 24×24×¼ inches are prepared using the process illustrated in FIG. 2. The aqueous leaching solution sprayed on leach dump 200 from line 220 is a sulfuric acid solution having a sulfuric acid concentration of 20 grams per liter. The copper-rich aqueous leach solution that is pumped to mixer 212 through line 226 has a copper ion concentration of 1.8 grams per liter and a free sulfuric acid concentration of 12 grams per liter. The organic solution is a 7% by weight solution of LIX 984 in SX-7. The concentration of copper in the copper-bearing organic solution that is added to mixer 212 from settler 204 has a copper concentration of 1.95 grams per liter. The copper-rich organic solution that is pumped to mixer 214 from settler 202 has a copper concentration of 3 grams per liter of LIX 984. The copper-depleted stripping solution added to mixer 214 from line 238 has a free sulfuric acid concentration of 170 grams per liter and a copper ion concentration of 40 grams per liter. The copper-depleted organic solution that is pumped from settler 206 to mixer 210 has a copper concentration of 1.25 grams per liter of LIX 984. The copper-containing aqueous leach solution pumped from settler 202 to mixer 210 has a copper ion concentration of 0.8 grams per liter and a free sulfuric acid concentration of 12 grams per liter. The copper-depleted aqueous solution pumped from settler 204 through line 220 has a copper concentration of 0.15 grams per liter and a free sulfuric acid concentration of 12 grams per liter. The copper-rich stripping solution taken from settler 206 has a copper ion concentration of 50 grams per liter and a free sulfuric acid concentration of 160 grams per liter. 140 gallons of this copper-rich stripping solution are recirculated through a mixer/settler at a rate of 2 gallons per minute (gpm). A fresh stream of copper-rich organic solution having a copper concentration of 3 grams per liter of LIX 984 in the solution is added to the mixer, also at a rate of 2 gpm. Sulfuric acid is added as needed to ensure acceptable stripping kinetics. The temperature of the copper-rich stripping solution is maintained at or above 37.8° C. to prevent crystallization of copper sulfate. The final electrolyte solution produced from this procedure has a copper ion concentration of 92 grams per liter and a free sulfuric acid concentration of 83 grams per liter. This electrolyte solution is advanced to electroforming cell 106. The electrolyte solution in cell 106 does not have a free chloride ion level that is detectable. No organic additives are added to this electrolyte solution. Electrodeposition is continued is cell 106 until the copper plates 130 are formed.

Metal Working Steps to Form the Copper Wire

The circular disk of copper that is formed during step (A) of the inventive process is either electrodeposited directly in the form of a circular disk, or is electrodeposited in the form of a square or rectangular plate of copper which is subsequently cut using known techniques (e.g., stamping, punching, machining, etc.) to form the circular disk. The circular disk is then subjected to the metal working steps of rotating the circular disk about its center axis, feeding a cutting tool into the peripheral edge of the circular disk to cause a strip of copper to peel from the disk, slitting the strip of copper to form a plurality of strands of copper wire, and shaping the strands of copper wire to provide such strands with desired cross sectional shapes and sizes.

The peeling step of the inventive process, which includes rotating the circular disk about its center axis and feeding a cutting tool into the peripheral edge of the disk to cause a strip of copper to peel from the disk, is sometimes referred to in the art by the term "skiving."

Figure 4:
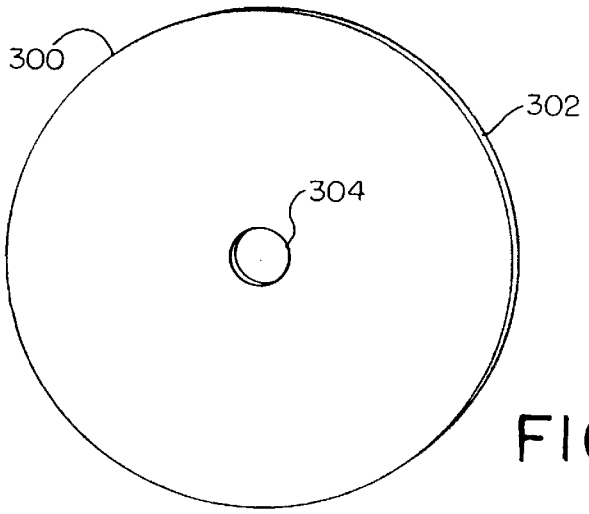
FIG. 4 is a schematic illustration of the circular disk of copper used with the inventive process.

Referring to FIGS. 3 and 4, the electrodeposited copper plate 130, in one embodiment, is cut using standard techniques to form circular disk 300. The circular disk 300 has a peripheral edge 302 and a center hole 304. The circular disk 300 has one side that is smooth or shiny and an opposite side which has a rough or matte surface. The smooth or shiny side is the side that was in contact with the surface of the cathode during electrodeposition. In one embodiment, the rough or matte surface of the circular disk is machined to form a smooth or shiny surface prior to the peeling step. However, in one embodiment, this machining step is eliminated. In fact, an advantage of this invention is that it is not necessary to smooth out the rough or matte surface of the circular disk prior to peeling.

Figure 5:
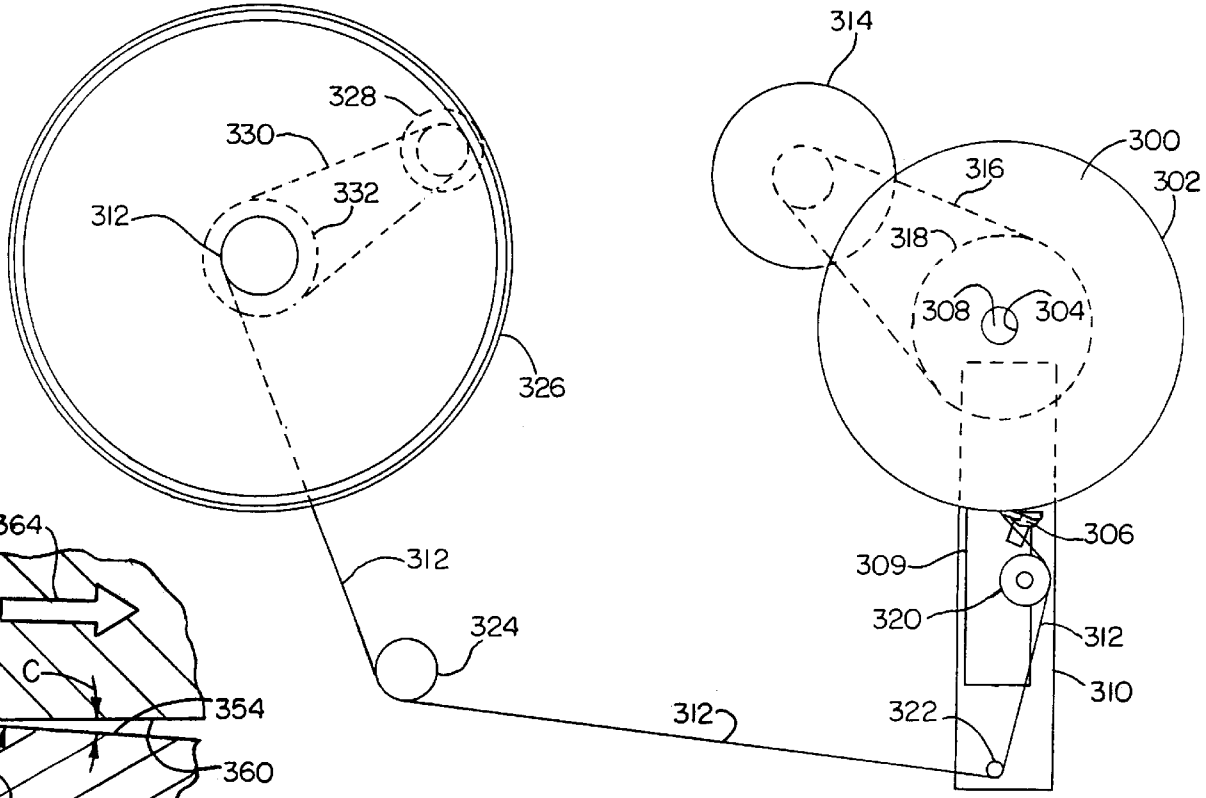
FIG. 5 is a schematic illustration of the top plan view of an apparatus used for the peeling step of the inventive process wherein a cutting tool is fed into the peripheral edge of a circular disk of copper and a strip of copper is peeled from the edge of the circular disk.
Figure 5A:
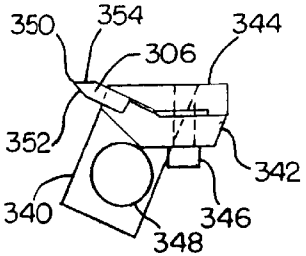
FIG. 5A is an enlarged top plan view of the cutting tool illustrated in FIG. 5.
Figure 5B:
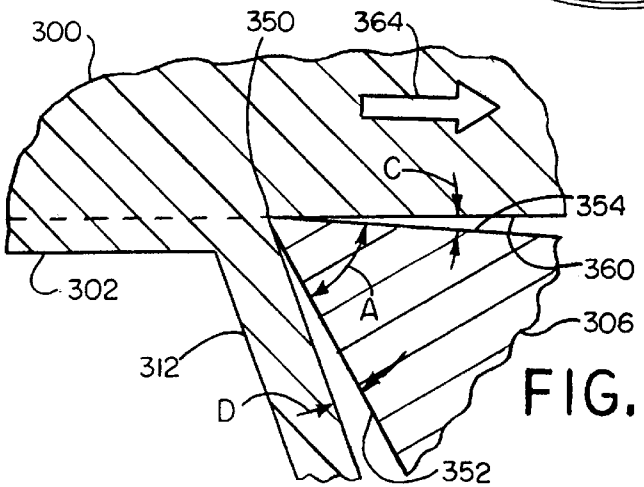
FIG. 5B is an enlarged partial schematic illustration of the cutting of the peripheral edge of the circular disk using the cutting tool illustrated in FIG. 5A during the peeling step of the inventive process.

The peeling step of the inventive process may be best understood with reference to FIGS. 5, 5A and 5B. Referring to FIG. 5, the apparatus used for the peeling step includes a disk support apparatus (not shown) for supporting circular disk 300. The disk support apparatus can be of any conventional design that permits the rotation of disk 300 and the penetration of cutting tool 306 into the peripheral edge 302 of disk 300. For example, the disk support apparatus may include a horizontally aligned ball transfer unit. The disk support apparatus includes a spindle 308 that projects upwardly from the support apparatus through center hole 304. Disk 300 is secured to spindle 308. During the peeling step, circular disk 300 rotates counterclockwise in a horizontal plane on the disk support apparatus. Cutting tool 306 is mounted on sliding block 309. Sliding block 309 is mounted on slide 310 and is adapted for horizontal movement along slide 310 in the radial direction relative to disk 300 (up and down as depicted in FIG. 5). Slide 310 has a horizontal surface positioned below and parallel to circular disk 300. During the peeling step, sliding block 309 is driven horizontally along slide 310 form the outer edge of disk 300 toward the center of disk 300 by a cutting tool feed motor (not shown). The movement of sliding block 309 causes tool 306 to penetrate the peripheral edge 302 of circular disk 300 and peel cooper strip 312 from edge 302 as the disk 300 rotates. Disk 300 is rotted by spindle motor 314. Spindle motor 314 drives drive chain 316 which is connected to spindle drive 318. Spindle drive 318 is part of spindle 308 and the rotation of spindle drive 318 results in the rotation of spindle 308 and disk 300. Copper strip 312 is peeled from the peripheral edge 302 of disk 300 and advanced along rolls 320, 322 and 324 to take-up reel 326. Roll 320 is mounted on sliding block 309. Roll 322 is mounted on slide 310. Take up reel 326 is rotated by take up motor 328. Take-up motor 328 is connected to take-up reel 326 through drive chain 330 and take up drive 332. The rotation of take-up reel 326 results in the winding of copper strip 312 around take-up reel 326, and provides a desired tension (e.g., about 1 to about 20 pounds of force, and in one embodiment about 1 to about 8 pounds of force, and in one embodiment about 1 to about 2 pounds of force) in copper strip 312 as it is peeled from circular disk 300.

Cutting tool 306 is illustrated in greater detail in FIG. 5A. Cutting tool 306 is mounted on tool holder 340 and secured in fixed position between clamps 342 and 344. Clamp 342 forms a part of tool holder 340 and projects vertically upwardly from holder 340. Clamp 344 is secured to clamp 342 by bolt 346. Tool holder 340 is mounted on sliding block 309 and secured thereto by bolt 348. Cutting tool 306 has a sharpened edge 350, rake face 352 and a clearance face 354. The sharpened edge 350 has an included angle A of about 40° to about 60° and in one embodiment about 40° to about 47°, and in one embodiment about 45° to about 47°, formed at the intersection of the rake face 352 and clearance face 354. In one embodiment, the finish on both the rake face 352 and clearance face 354 is an 8–12 RMS finish. The sharpened edge preferably has no imperfections greater than about 16 microns. Cutting tool 306 is a carbide tool which can have a grade of K68, K91, K910 or VR Wesson 660. In one embodiment, the composition of cutting tool 306 comprises tungsten carbide. In one embodiment, the cutting tool 306 has a composition comprising about 60% by weight tungsten carbide, about 12% by weight cobalt, and about 28% by weight tantalum carbide.

The penetration of cutting tool 306 into circular disk 300 is illustrated in FIG. 5B. Tool 306 is positioned so that the clearance face 354 is at an angle C of about 2° to about 4°, and in one embodiment about 2° to about 3°, from the tangent of the disk surface 360. During a peeling run, the disk 300 rotates in the direction indicated by arrow 364 and the copper strip 312 is peeled from the disk. During the threading stage of a peeling run, the speed of the disk surface (i.e., peripheral edge 302) is about 1 to about 50 feet per minute, and in one embodiment about 10 to about 30 feet per minute. The run speed is about 5 to about 5000 feet per minute, and in one embodiment about 100 to about 2000 feet per minute, and in one embodiment about 200 to about 1000 feet per minute, and in one embodiment about 400 to about 600 feet per minute, and in one embodiment about 500 feet per minute. The angle D between the rake face 352 and the copper strip 312 is typically up to about 5°, and in one embodiment about 0.5° to about 5°, as the copper strip is peeled off.

During the peeling step, a coolant or lubricant can optionally be used to cool and/or lubricate the cutting tool 306. Any coolant or lubricant known for use in the peeling of copper can be used.

The copper strip 312 typically has a thickness of about 0.002 to about 0.5 inch, and in one embodiment about 0.002 to about 0.25 inch, and in one embodiment about 0.002 to about 0.1 inch, and in one embodiment about 0.002 to about 0.05 inch, and in one embodiment about 0.006 to about 0.02 inch. The copper strip 312 typically has a width of 0.1 to about 1 inch, and in one embodiment about 0.1 to about 0.5 inch, and in one embodiment about 0.2 to about 0.3 inch. In one embodiment, the copper strip 312 has a width of about 0.25 inch, and a thickness of about 0.008 to about 0.012 inch. The length of the copper strip 312 is typically in the range of about 100 to about 40,000 feet, and in one embodiment about 100 to about 20,000 feet, and in one embodiment about 100 to about 10,000 feet, and in one embodiment about 500 to about 5000 feet, and in one embodiment about 900 to about 3000 feet.

Figure 5C:
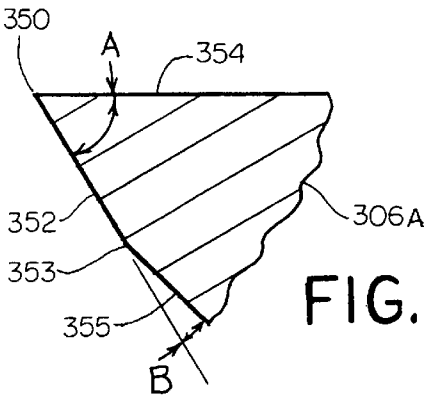
FIG. 5C is an enlarged partial schematic illustration of a modified design of the cutting tool illustrated in FIG. 5A.

A modified design of the cutting tool 306 is illustrated in FIG. 5C. The modified cutting tool 306A illustrated in FIG. 5C is identical to the cutting tool 306 illustrated in FIGS. 5, 5A and 5B with the exception that the tool 306A has a relief face 355 extending from rake face 352 away form sharpened edge 350 at an angle B to rake face 352. Angle B is up to about 5°, and in one embodiment is in the range of about 1° to about 5°. The length of the rake face 352, which extends form sharpened edge 352 to edge 353, is about 0.002 to about 0.01 inch, and in one embodiment shown 0.005 inch.

The slitting step of the inventive process is best illustrated with reference to FIGS. 6–8. In this step of the process, the copper strip 312 that is peeled from the circular disk 300 is slit to form a plurality of strands of wire having square or rectangular cross sections. In the illustrated embodiment depicted in FIGS. 6–8, the copper strip 312 is slit using slitter 380 to form product wire strands 402, 404, 406, 408 and 410. Scrap wire strands 400 and 412 are also formed. The sequence of this process step involves unwinding the copper strip 312 from reel 326, advancing it through accumulator 370 to tension sheave 372, and around tension sheave 372 to slitter 380. Accumulator 370 includes fixed sheave 374 and dancer sheave 376 which are provided for maintaining tension in copper strip 312 as it is advanced to slitter 380. In slitter 380, the copper strip 312 is slit to form wire strands 402, 404, 406, 408 and 410, and these wire strands are advanced from slitter 380 to product spools 382, 384, 386, 388 and 390, respectively. Scrap wire strands 400 and 412 are also formed in slitter 380, and these strands are advanced to spools 392 and 394, respectively. The scrap wire strands 400 and 412 may be recycled to dissolution vessel 100. The product wire strands 402, 404, 406, 408 and 410 have square or rectangular cross sections, each of the strands having, in one embodiment, widths of about 0.008 to about 0.02 inch, and in one embodiment about 0.008 to about 0.012 inch; and thicknesses (or heights) of about 0.002 to about 0.2 inch, and in one embodiment about 0.002 to about 0.1 inch, and in one embodiment about 0.006 to about 0.01 inch. In one embodiment, each of the product wire strands has a rectangular cross section, the width being about 0.012 inch and the thickness (or height) being about 0.008 inch. In one embodiment, each of the product wire strands has square or substantially square cross-sections that is from about 0.005×0.005 inch to about 0.050×0.050 inch, or about 0.010×0.010 inch to about 0.030×0.030 inch, or about 0.020×0.020 inch.

As indicated above, one advantage of the inventive process is that the circular disk 300 does not have to be smoothed or machined prior to the peeling and slitting steps of the inventive process. This is due to the fact that the slitting step takes into account for any irregularities on the edges of the copper strip 312 by providing for the production of the scrap wire strands 400 and 412.

Figure 7:
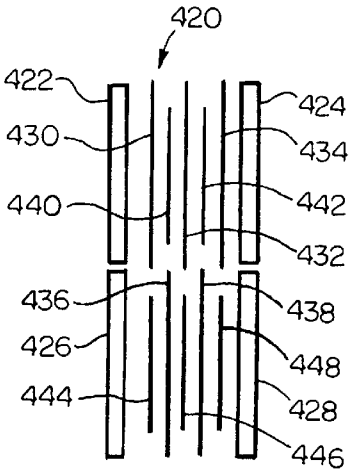
FIG. 7 is a schematic illustration of a fragmented strip of copper which has been partially slit pursuant to the inventive process.
Figure 8:
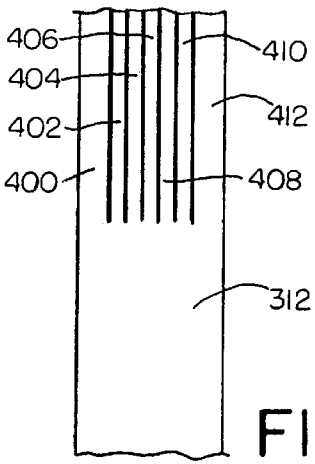
FIG. 8 is an exploded schematic illustration of the cutting blades used to slit a strip of copper during the slitting step of the inventive process.

In slitter 380, the copper strip 312 is slit using a cutting blade assembly which is schematically illustrated in FIG. 7 and identified generally by the reference numeral 420. The cutting blade assembly 420 includes edge spacers 422, 424, 426 and 428, cutting blades 430, 432, 434, 436 and 438, and spacers 440, 442, 444, 446 and 448. The cutting blades and spacers can be constructed of any tool steel suitable for cutting copper foil. An example of such a tool steel is M2. The thicknesses (or widths) of the cutting blades 430, 432, 434, 436 and 438 are typically in the range of about 0.002 to about 0.2 inch, and in one embodiment about 0.008 to about 0.014 inch, and in one embodiment about 0.0105 inch. The thicknesses (or widths) of the spacers 440, 442, 444, 446 and 448 are typically in the range of about 0.002 to about 0.2 inch, and in one embodiment about 0.008 to about 0.014 inch, and in one embodiment about 0.011 inch. The thickness (or width) of the edge spacers 422, 424, 426 and 428 can range from about 0.1 to about 0.5 inch, and in one embodiment about 0.2 to about 0.4 inch, and in one embodiment each of their thicknesses are about 0.3745 inch. The diameters of the edge spacers and the cutting blades can range from about 2 to about 6 inches, and in one embodiment about 3 to about 5 inches. The diameters of the spacers 440, 442, 444, 446 and 448 can range from about 2 to about 6 inches, and in one embodiment about 3 to about 5 inches. The cutting blade assembly 420 may include additional cutting blades and spacers which are not shown in the drawings but would be readily apparent to those skilled in the art.

In one embodiment, a metal working lubricant is applied ot the surface of copper strip 312 as it is advanced through the slitter 380. The lubricant may be any known metal working lubricant that is used for cutting or slitting copper. An example is Die Magic, which is a product of Diversified Technology Incorporated.

As indicated above, the copper strip 312 is slit in slitter 380 to form product wire strands 402, 404, 406, 408 and 410 as well as scrap wire strands 400 and 412. All of these wire strands are advanced from slitter 380 over wire guides (or rollers) 480 and 482 to guide 484, and then under guide 484 to guide 486. Wire strand 402 is advanced over guide 486, around guide 488 to product spool 382. Guide 484 is equipped with a load sensor which senses the tension in the wire strands in contact with it and this information is used to control the rotation of spool 382 and thereby control the tension in wire strand 402. The remaining wire strands are advanced to guide 490, and then under guide 490 to guide 492. Wire strand 404 is advanced from guide 492 to spool 384. Guide 490 is equipped with a load sensor which senses the tension in the wire strands in contact with it and provides a signal for controlling the rotation of spool 384 and the tension in wire strand 404. The remaining wire strands are advanced from guide 492 to guide 494, and then under guide 494 to guide 496. Wire strand 406 is advanced from guide 496 around guide 498 to spool 386. Guide 494 is equipped with a load sensor which senses the tension in the wire strands in contact with it and provides a signal to control the rotation of spool 386 and thereby control the tension in wire strand 406. The remaining wire strands are advanced from guide 496 to guide 500, and then under guide 500 to guide 502. Wire strand 408 is advanced from guide 502 to spool 388. Guide 500 is equipped with a load sensor which provides a signal to control the rotation of spool 388 and thereby control the tension in wire strand 408. The remaining wire strands are advanced from guide 502 to guide 504, and then under guide 504 to guide 506. Wire strand 410 is advanced from guide 506 around guide 508 to spool 390. Guide 504 is equipped with a load sensor which senses the tension in the wire strands in contact with it and provides a signal to control the rotation of spool 390 and thereby control the tension in wire strand 410. The remaining wire strands are advanced from guide 506 to guide 510, and then under guide 510 to guide 512. Wire strand 400 is advanced from guide 512 to guide 514, and then around guide 514 to spool 392. Guide 510 is equipped with a load sensor that provides a signal to control the rotation of spool 392 and thereby control the tension in wire strand 400. Wire strand 412 is advanced from guide 512 to guide 516, under guide 516 to guide 518, over guide 518 to guide 520, and under guide 520 to spool 394. Guide 516 is equipped with a load sensor that senses the tension in wire strand 412 and provides a signal to control the rotation of spool 394 and thereby control the tension in wire strand 412.

Figure 6:
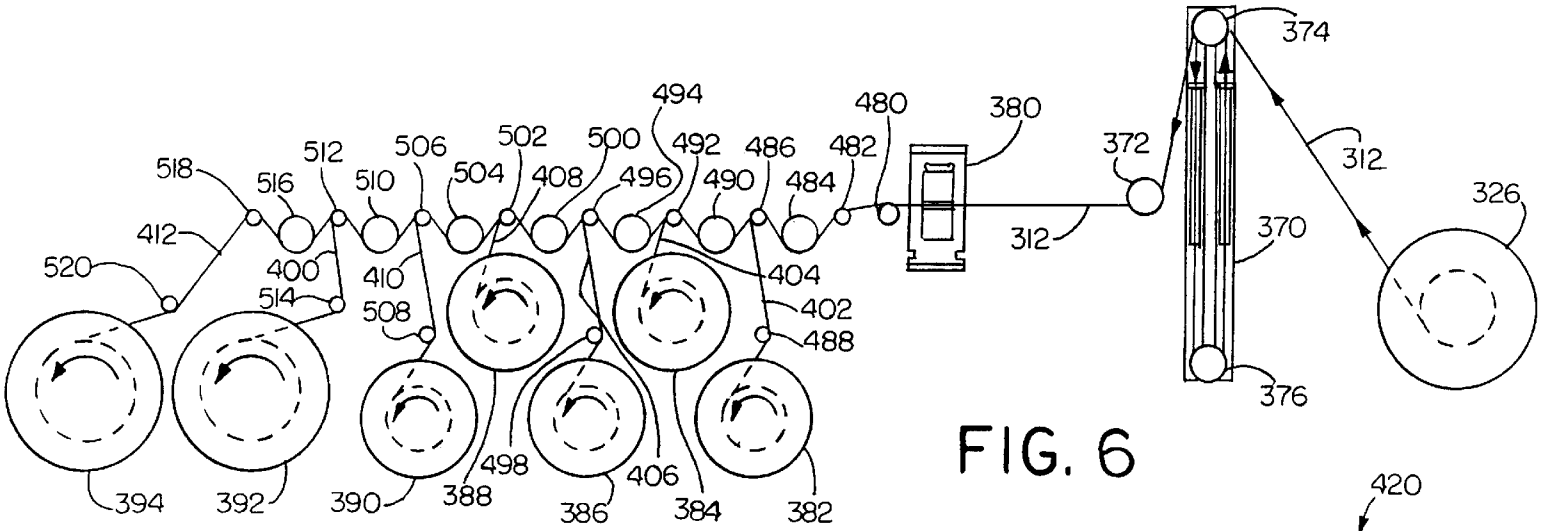
FIG. 6 is a schematic illustration of the slitting step used with the inventive process wherein a strip of copper is slit to form a plurality of strands of copper wire.

It will be apparent to those skilled in the art that although the slitter assembly disclosed in FIGS. 6 and 7 provides for the production of five product wire strands and two scrap wire strands, additional product wire strands can be produced by providing additional cutting blades in the cutting blade assembly 420. Similarly, the width of the product wire strands that are produced can be varied by varying the size of the spacers used in the cutting blade assembly 420. Also, the lengths of the product wire strands produced by this assembly can be varied by varying the length of the copper strip 312 that is used with this slitting step. The product wire strands that are produced can be welded to other similarly produced wire strands using known techniques (e.g., butt welding) to produce wire strands having longer lengths.

Generally, the copper wire made in accordance with the invention can have any cross-sectional shape that is conventionally available. These include round cross sections, squares, rectangles, trapazoids, polygons, ovals, etc. The edges on these shapes can be sharp or rounded. These wires can be made using one or a series or combination of Turks heads mills, and/or drawing dies to provide the desired shape and size. They can have cross sectional diameters or major dimensions in the range of about 0.0002 to about 0.25 inch, and in one embodiment about 0.002 to about 0.1 inch, and in one embodiment about 0.004 to about 0.05 inch, and in one embodiment about 0.006 to about 0.012 inch, and in one embodiment about 0.008 to about 0.012 inch.

In one embodiment, the strands of copper wire are rolled using one or a series of Turks heads shaping mills wherein in each shaping mill the strands are pulled through two pairs of opposed rigidly-mounted forming rolls. In one embodiment, these rolls are grooved to produce shapes (e.g., rectangles, squares, etc.) with rounded edges. Powered Turks head mills wherein the rolls are driven can be used. The Turks head mill speed can be about 100 to about 5000 feet per minute, and in one embodiment about 300 to about 1500 feet per minute, and in one embodiment about 600 feet per minute.

In one embodiment, the wire strands are subjected to sequential passes through three Turks head mills to convert a copper wire with a rectangular cross section to a wire with a square-cross section. In the first, the strands are rolled from a cross-section of 0.005×0.010 inch to a cross-section of 0.0052×0.0088 inch. In the second, the strands are rolled from a cross-section of 0.0052×0.0088 inch to a cross-section of 0.0054×0.0070 inch. In the third, the strands are rolled from a cross-section of 0.0054×0.0070 inch to a cross-section of 0.0056×0.0056 inch.

In one embodiment, the strands of wire are subjected to sequential passes through two Turks head mills. In the first, the strands are rolled from a cross-section of 0.008×0.010 inch to a cross-section of 0.0087×0.0093 inch. In the second, the strands are rolled from a cross-section of 0.0087×0.0093 inch to a cross-section of 0.0090×0.0090 inch.

In one embodiment, the strands of wire that are made in accordance with the invention are drawn through a die or a series of dies to provide the strands with round cross-sections. The die can be a shaped (e.g., square, oval, rectangle, etc.)-to-round pass die wherein the incoming strand of wire contacts the die in the drawing cone along a planar locus, and exits the die along a planar locus. The die or dies can be round-to-round pass dies. The included die angle, in one embodiment, is about 0°, 12°, 16°, 24° or others known in the art. In one embodiment, prior to being drawn, the strands of wire are cleaned and welded (as discussed above).

Wires having gauges of about 29 AWG to about 36 AWG, and in one embodiment about 33 AWG to about 35 AWG, can be formed. In one embodiment, a strand of wire having a square cross-section of 0.0056×0.0056 inch is drawn through a die in a single pass to provide a wire with a round cross-section and a cross-sectional diameter of 0.0056 inch (AWG 35).

Figure 9:
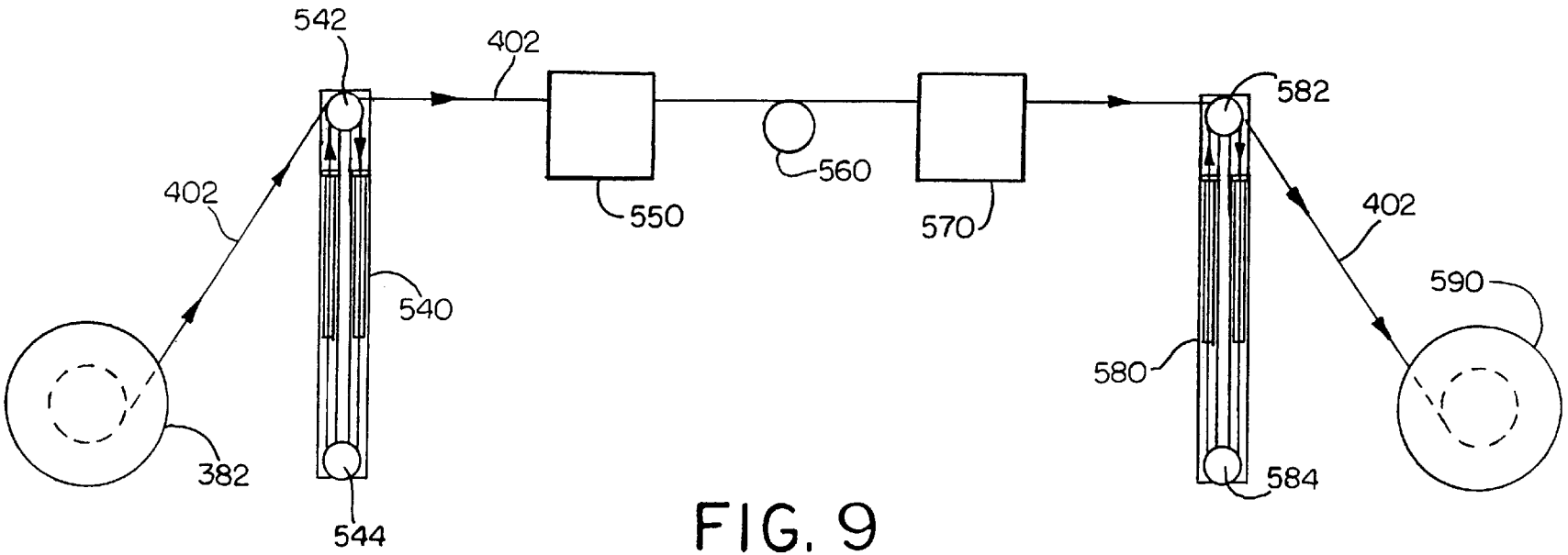
FIG. 9 is a flow sheet illustrating the step of converting a strand of copper wire having a square or rectangular cross section to a strand of copper wire having a round cross section.

In one embodiment, the square or rectangular cross-sectioned wire strands produced by the slitting step of the inventive process are initially subjected to treatment in a shaping line where the cross sections are converted from such squares or rectangles to wire strands with round or oval cross sections. The wire strands with oval or round cross sections are then drawn through round dies to provide wire strands with round cross sections of desired size. Referring to FIG. 9, wire strand 402 is unwound from spool 382 and advanced to accumulator 540. (Alternatively, any of wire strands 404, 406, 408 or 410 may be unwound from spools 384, 386, 388 or 390, respectively, and advanced to accumulator 540.) Wire strand 402 is then advanced from accumulator 540 to shaping unit 550. Accumulator 540 includes fixed sheave 542 and dancer sheave 544 which are provided for maintaining the tension in wire strand 402 as it is advanced to shaping unit 550. Wire strand 402 entering shaping unit 550 typically has a square or rectangular cross section with a width of about 0.006 to about 0.02 inch, and in one embodiment about 0.010 to about 0.014 inch; and a height (or thickness) of about 0.002 to about 0.02 inch, and in one embodiment about 0.006 to about 0.01 inch. In one embodiment, the wire strand 402 entering shaping unit 550 has a rectangular cross section with the dimensions of about 0.008×0.012 inch. The shaping mill 550 is comprised of a power driven Turks head mill, a pull-through Turks head mill in combination with a capstan unit, or a die box in combination with a capstan unit. In shaping unit 550, the cross section of the wire strand 402 is transformed from a rectangular or square shape to an oval shape. In one embodiment, the major diameter of the oval is about 0.008 to about 0.014 inch, and in one embodiment about 0.008 to about 0.010 inch; and the minor diameter is about 0.004 to about 0.01 inch, and in one embodiment about 0.006 to about 0.009 inch. In one embodiment, the wire strand that is shaped in shaping unit 550 has an oval cross section with a major diameter of about 0.010 inch and a minor diameter of about 0.008 inch. Wire strand 402 is advanced from shaping unit 550 over dead weight dancer sheave 560 to shaping unit 570. Shaping unit 570 is comprised of a die box in combination with a capstan unit. In shaping unit 570 the oval shape of the cross section of the wire is rounded to form a round cross section or a nearly rounded cross section. In one embodiment, the wire strand that is shaped in shaping unit 570 is round or nearly round and has a major diameter of about 0.008 to about 0.012 inch, and in one embodiment about 0.009 to about 0.010 inch. In one embodiment, the wire strand that is formed in shaping unit 570 is substantially round with a major diameter of 0.009 inch and a minor diameter of 0.008 inch. The wire strand is advanced from shaping unit 570 through accumulator 580 to spool 590 where it is wound. Accumulator 580 includes fixed sheave 582 and dancer sheave 584 which are provided for maintaining tension in the copper wire strand as it is advanced from shaping unit 570 to spool 590.

Figure 10:
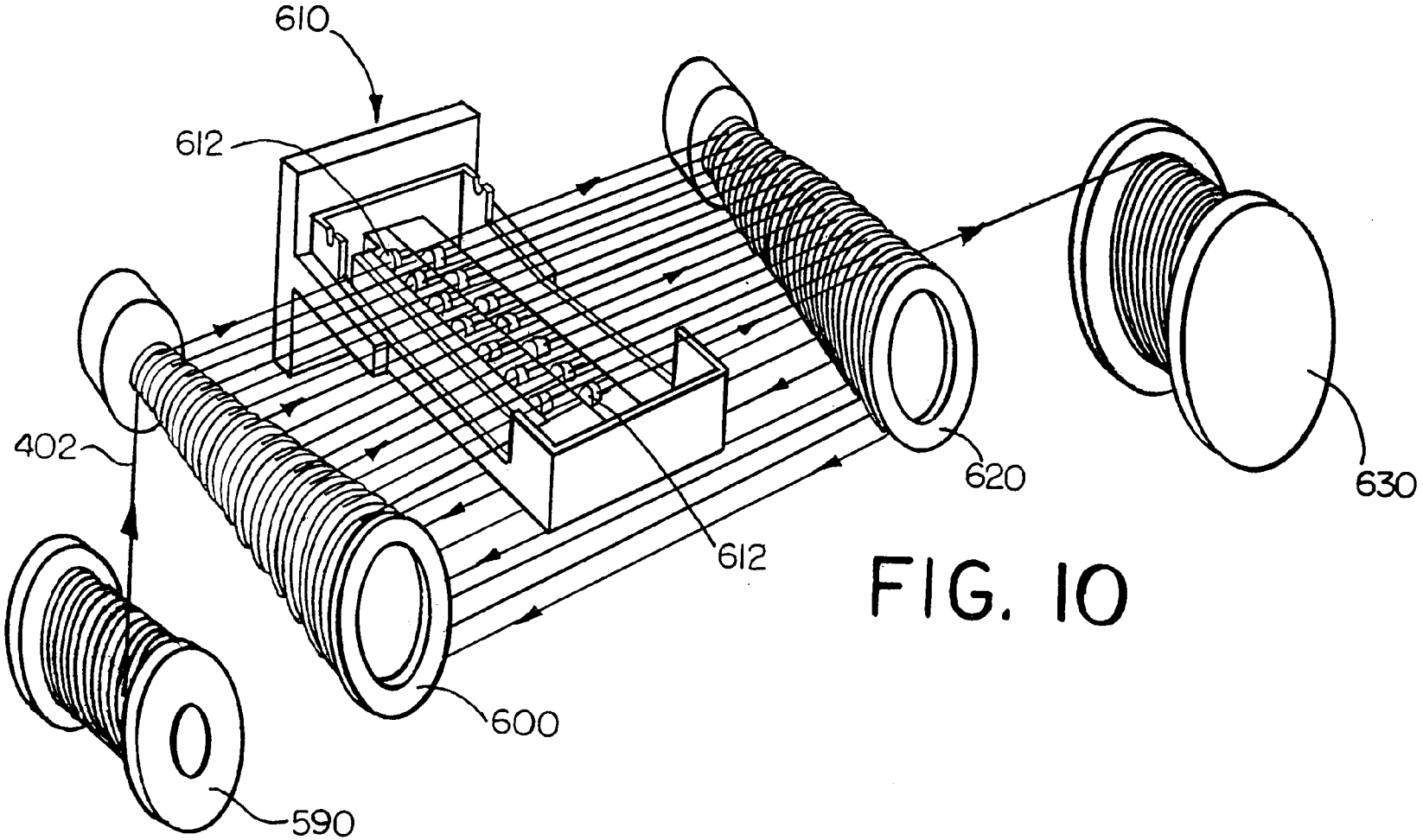
FIG. 10 is a schematic illustration of a process for drawing copper wire pursuant to the inventive process.

Referring now to FIG. 10, the round or substantially round wire strand 402 produced in shaping unit 570 (FIG. 9) is drawn through a series of dies in die box 610 to produce a wire strand with a round cross section and desired diameter which is collected on spool 630. Die box 610 contains an array of round dies 612 selected to reduce the wire strand to the desired diameter or wire gauge. In FIG. 10, there are 14 dies depicted, but those skilled in the art will recognize that any desired number of dies can be used. Wire 402 is advanced from spool 590, over sheave 600, through the first die in die box 610, around sheave 620, under die box 610, around sheave 600 and to and through the second die in die box 610 and is then advanced to sheave 620, and from sheave 620 to spool 630 where it is collected. The reduction required for each die can be determined by those skilled in the art. In one embodiment, a full reduction is achieved in each die (e.g., 34 AWG to 35 AWG). In one embodiment, a ⅓ reduction is achieved with each die (e.g., 34 AWG to 34 ⅓ AWG). During the reduction in die box 610, conventional metal working lubricants are employed for the purpose of lubricating the dies. Any metal working lubricant suitable for drawing copper wire can be used. Examples include HSDL No.2 and HSDL No.20, both of which are products of G. Whitfield Richards Co. During this wire drawing step, the wire strands can be reduced from about AWG 32 to about AWG 48, and in one embodiment from about AWG 32 to about AWG 54. In one embodiment, copper wire strands having gauges of about AWG 32 to about AWG 60 can be made. In a particularly advantageous embodiment, wire strands having gauges of about AWG 20 to about AWG 60, and in one embodiment about AWG 30 to about AWG 60, and in one embodiment about AWG 40 to about AWG 60, and in one embodiment about AWG 45 to about AWG 60, and in one embodiment about AWG 50 to about AWG 60, and in one embodiment about AWG 55 to about AWG 60 can be made.

An advantage of the present invention is that fine wire having gauges of about AWG 50 to about AWG 60, and in one embodiment about AWG 55 to about AWG 60 can be made. This is because the grain structure of the copper wire can be controlled within precise ranges by controlling the chemistry of the electrodeposition baths used to electrodeposit the copper used to make the wire.

EXAMPLE 10

A copper strip 312 having a width of 0.25 inch, a thickness of 0.008" inch and a length of 100 feet is peeled from a circular disk 300 of copper having a diameter of 6 inches using the apparatus illustrated in FIGS. 5, 5A and 5B. The copper strip 312 is sheared using the apparatus illustrated in FIGS. 6 and 7 to form five strands of wire, each having a cross section of 0.008×0.012". These wire strands are degreased, washed, rinsed, pickled, electropolished, rinsed and dried. The strands of wire are shaped to a round cross section using a combination of rolls and drawing dies. The first pass uses a miniaturized powered Turks head shaping mill to reduce the 0.012" dimension sides to approximately 0.0010–0.011". The next pass is through a second Turks head mill wherein this dimension is further compressed to approximately 0.008–0.0010", with the overall cross section being squared. Both passes are compressive, relative to the dimensions cited above, with an increase in the transverse dimension (the dimension in the cross section direction perpendicular to the direction of compression) and an increase in wire length. The edges are rounded with each pass. The strands of wire are then passed through a drawing die wherein they are rounded and elongated, the diameter being reduced to 0.00795", AWG 32.

Copper Wire Made by the Inventive Process

In one embodiment, the copper wire produced by the inventive process has a substantially uniform unoriented grain structure that is essentially columnar grain free. In one embodiment, the grain structure for this wire is essentially twin boundary free. In one embodiment, this wire is substantially porosity free. The expressions "essentially columnar grain free", "essentially twin boundary free", and "substantially porosity free" refer to the fact that in most instances microscopic or transmission electron microscopy (TEM) analysis of the wire demonstrates that such wire is columnar grain free, twin boundary free or porosity free, but that on occasions minor amounts of columnar grain formation, twin boundary formation and/or porosity may be observed. In one embodiment, this wire is free of oxide inclusions. Copper wire having these characteristics can be drawn more easily than wire that does not have such characteristics.

In one embodiment, the wire made by the inventive process has a copper content of about 99% to about 99.999% by weight, and in one embodiment about 99.9% to about 99.99% by weight.

In one embodiment, the wire made by the inventive process has an ultimate tensile strength (UTS) at 23° C. in the range of about 60,000 psi to about 95,000 psi, and in one embodiment about 60,000 psi to about 85,000 psi, and in one embodiment about 65,000 psi to about 75,000 psi. In one embodiment, the elongations for this wire at 23° C. are about 8% to about 18%, and in one embodiment about 9% to about 16%, and in one embodiment about 9% to about 14%.

In one embodiment, the wire made by the inventive process is cold worked to a reduction of about 60% and as such has a tensile strength in the range of about 65,000 psi to about 90,000 psi, and in one embodiment about 70,000 psi to about 75,000 psi; and an elongation about 0% to about 4%, and in one embodiment about 0% to about 2%, and in one embodiment about 1%.

In one embodiment, the wire made by the inventive process is cold worked to a reduction of about 60% and then annealed at a temperature of 200° C. for two hours and as such has a tensile strength in the range of about 25,000 psi to about 40,000 psi, and in one embodiment about 27,000 psi to about 30,000 psi; and an elongation of about 30% to about 40%.

In one embodiment, the copper wire made by the inventive process has a conductivity of at least about 100% IACS (International Annealed Copper Standard), and in one embodiment about 100% to about 102.7% IACS.

The wire made by the inventive process can be cleaned using known chemical, mechanical or electropolishing techniques. Chemical cleaning can be effected by passing the wire through an etching or pickling bath of nitric acid or hot (e.g., about 25° C. to 70° C.) sulfuric acid. Electropolishing can be effected using an electric current and sulfuric acid. Mechanical cleaning can be effected using brushes and the like for removing burrs and similar roughened portions form the surface of the wire. In one embodiment, the wire is degreased using a caustic soda solution, washed, rinsed, pickeled using hot (e.g., about 35° C.) sulfuric acid, electropolished using sulfuric acid, rinsed and dried.

In one embodiment, the strands of wire made by the inventive process have lengths of up to about 100,000 feet, and in one embodiment from about 5000 to about 50,000 feet, and in one embodiment about 10,000 to about 50,000 feet. In one embodiment, strands of wire made by the inventive process have relatively short lengths (e.g., about 500 to about 5000 ft, and in one embodiment about 1000 to about 3000 ft, and in one embodiment about 2000 ft), and these strands of wire can be welded to other similarly produced strands of wire using known techniques (e.g., butt welding) to produce strands of wire having relatively long lengths (e.g., lengths in excess of about 100,000 ft, or in excess of about 200,000 ft, up to about 1,000,000 ft or more).

An advantage of this invention is that the properties of the wire made by the inventive process can be controlled to a great extent by controlling the composition of the electrolyte solution. Thus, for example, electrolyte solutions containing no organic additives and having a free chloride ion concentration of below 1 ppm, and in one embodiment zero or substantially zero, are particularly suitable for producing ultra thin copper wire (e.g., about AWG 40 to about AWG 60, and in one embodiment about AWG 50 to about AWG 60).

In one embodiment, the wire made by the inventive process is coated with one or more of the following coatings:

| | | |
|---|---|---|
| (1) | Lead, or lead alloy (80Pb—20Sn) | ASTM B189 |
| (2) | Nickel | ASTM B355 |
| (3) | Silver | ASTM B298 |
| (4) | Tin | ASTM B33 |

These coatings are applied to (a) retain solderability for hookup-wire applications, (b) provide a barrier between the copper and insulation materials such as rubber, that would react with the copper and adhere to it (thus making it difficult to strip insulation from the wire to make an electrical connection) or (c) prevent oxidation of the copper during high-temperature service. Tin-lead alloy coatings and pure tin coatings are the most common; nickel and silver are used for specialty and high-temperature applications. The copper wire may be coated by hot dipping in a molten metal bath, electroplating or cladding. In one embodiment, a continuous process is used; this permits "on line" coating following the wire-drawing operation.

Stranded wire may be produced by twisting or braiding several wires together to provide a flexible cable. Different degrees of flexibility for a given current-carrying capacity can be achieved by varying the number, size and arrangement of individual wires. Solid wire, concentric strand, rope strand and bunched strand provide increasing degrees of flexibility; within the last three categories, a larger number of finer wires can provide greater flexibility.

Stranded wire and cable can be made on machines known as "bunchers" or "stranders." Conventional bunchers are used for stranding small-diameter wires (34 AWG up to 10 AWG). Individual wires are payed off reels located alongside the equipment and are fed over flyer arms that rotate about the take-up reel to twist the wires. The rotational speed of the arm relative to the take-up speed controls the length of lay in the bunch. For small, portable, flexible cables, individual wires are usually 30 to 44 AWG, and there may be as many as 30,000 wires in each cable.

A tubular buncher, which has up to 18 wire-payoff reels mounted inside the unit, can be used. Wire is taken off each reel while it remains in a horizontal plane, is threaded along a tubular barrel and is twisted together with other wires by a rotating action of the barrel. At the take-up end, the strand passes through a closing die to form the final bunch configuration. The finished strand is wound onto a reel that also remains within the machine.

In one embodiment, the wire is coated or covered with an insulation or jacketing. Three types of insulation or jacketing materials can be used. These are polymeric, enamel, and paper-and-oil.

In one embodiment, the polymers that are used are polyvinyl chloride (PVC), polyethylene, ethylene propylene rubber (EPR), silicon rubber, polytetrafluoroethylene (PTFE) and fluorinated ethylene propylene (FEP). Polyamide coatings are used where fire-resistance is of prime importance, such as in wiring harnesses for manned space vehicles. Natural rubber can be used. Synthetic rubbers can be used wherever good flexibility must be maintained, such as in welding or mining cable.

Many varieties of PVC are useful. These include several that are flame-resistant. PVC has good dielectric strength and flexibility, and is particularly useful because it is one of the least expensive conventional insulating and jacketing materials. It is used mainly for communication wire, control cable, building wire and low-voltage power cables. PVC insulation is normally selected for applications requiring continuous operation at low temperatures up to about 75° C.

Polyethylene, because of its low and stable dielectric constant, is useful when better electrical properties are required. It resists abrasion and solvents. It is used chiefly for hookup wire, communication wire and high-voltage cable. Cross-linked polyethylene (XLPE), which is made by adding organic peroxides to polyethylene and then vulcanizing the mixture, yields better heat-resistance, better mechanical properties, better aging characteristics, and freedom from environmental stress cracking. Special compounding can provide flame-resistance in cross-linked polyethylene. The usual maximum sustained operating temperature is about 90° C.

PTFE and FEP are used to insulate jet aircraft wire, electronic equipment wire and specialty control cables, where heat resistance, solvent resistance and high reliability are important. These electrical cables can operate at temperatures up to about 250° C.

These polymeric compounds can be applied over the wire using extrusion. The extruders are machines that convert pellets or powders of thermoplastic polymers into continuous covers. The insulating compound is loaded into a hopper that feeds it into a long, heated chamber. A continuously revolving screw moves the pellets into the hot zone, where the polymer softens and becomes fluid. At the end of the chamber, molten compound is forced out through a small die over the moving wire, which also passes through the die opening. As the insulated wire leaves the extruder it is water-cooled and taken up on reels. Wire jacketed with EPR and XLPE preferably go through a vulcanizing chamber prior to cooling to complete the cross-linking process.

Film-coated wire, usually fine magnet wire, generally comprises a copper wire coated with a thin, flexible enamel film. These insulated copper wires are used for electromagnetic coils in electrical devices, and must be capable of withstanding high breakdown voltages. Temperature ratings range from about 105° C. to about 220° C., depending on enamel composition. Useful enamels are based on polyvinyl acetals, polyesters and epoxy resins.

The equipment for enamel coating the wire is designed to insulate large numbers of wires simultaneously. In one embodiment, wires are passed through an enamel applicator that deposits a controlled thickness of liquid enamel onto the wire. Then the wire travels through a series of ovens to cure the coating, and finished wire is collected on spools. In order to build up a heavy coating of enamel, it may be necessary to pass wires through the system several times. Powder-coating methods are also useful. These avoid evolution of solvents, which is characteristic of curing conventional enamels, and thus make it easier for the manufacturer to meet OSHA and EPA standards. Electrostatic sprayers, fluidized beds and the like can be used to apply such powdered coatings.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A process for making copper wire, comprising:

(A) forming a circular disk of electrodeposited copper;

(B) rotating said disk about its center axis;

(C) feeding a cutting tool into the peripheral edge of said disk to cause a strip of copper to peel from said disk, the cutting tool moving from the outer peripheral edges of the disk towards the center of the disk and the strip of copper having a cross-sectional dimension corresponding to the axial dimension of the circular disk; and (D) slitting said strip of copper to form a plurality of strands of copper wire.

2. The process of claim 1 with the step of:

(E) shaping said strands of wire form step (D) to provide said strands with desired cross sections.

3. The process of claim 2 wherein said wire is shaped during step (E) to have a round cross-sectional shape.

4. The process of claim 2 wherein said wire is shaped during step (E) to have a square or rectangular cross-sectional shape.

5. The process of claim 2 wherein said wire is shaped during step (E) to have a cross-sectional shape in the form of a trapazoid, polygon or oval.

6. The process of claim 2 wherein said wire has a cross sectional diameter in the range of about 0.0002 to about 0.25 inch.

7. The process of claim 2 wherein said wire has a gauge of about 10 AWG to about 60 AWG.

8. The process of claim 2 wherein said wire is an ultra fine wire having a gauge of about 50 AWG to about 60 AWG.

9. The process of claim 1 wherein during step (A) said circular disk is electrodeposited directly on a cathode.

10. The process of claim 1 wherein during step (A) an electrolyte solution is positioned between an anode and a cathode and an effective amount of voltage is applied across said anode and said cathode to deposit copper on said cathode, said electrolyte solution comprising copper ions and sulfate ions and having a chloride ion concentration of up to about 10 ppm.

11. The process of claim 10 wherein during step (A) the current density is in the range of about 10 to about 100 ASF.

12. The process of claim 10 wherein said electrolyte solution contains at least one organic additive.

13. The process of claim 1 wherein step (A) includes the steps of:

(A-1) contacting a copper-bearing material with an effective amount of at least one aqueous leaching solution to dissolve copper ions into said leaching solution and form a copper-rich aqueous leaching solution;

(A-2) contacting said copper-rich aqueous leaching solution with an effective amount of at least one water-insoluble extractant to transfer copper ions from said copper-rich aqueous leaching solution to said extractant to form a copper-rich extractant and a copper-depleted aqueous leaching solution;

(A-3) separating said copper-rich extractant from said copper-depleted aqueous leaching solution;

(A-4) contacting said copper-rich extractant with an effective amount of at least one aqueous stripping solution to transfer copper ions from said extractant to said stripping solution to form a copper-rich stripping solution and a copper-depleted extractant;

(A-5) separating said copper-rich stripping solution from said copper-depleted extractant;

(A-6) flowing said copper-rich stripping solution between an anode and a cathode, and applying an effective amount of voltage across said anode and said cathode to deposit copper on said cathode; and (A-7) removing said copper from said cathode.

14. The process of claim 13 wherein prior to step A-6, additional copper and/or sulfuric acid is added to said copper-rich stripping solution.

15. The process of claim 13 wherein said copper-bearing material is copper ore, copper concentrate, copper smelter products, smelter flue dust, copper cement copper sulfate or copper-containing waste.

16. The process of claim 13 with the step of separating said copper-rich aqueous solution formed in step (A-1) form said copper-bearing material.

17. The process of claim 16 wherein during step (A-6) said copper-rich stripping solution has a chloride ion concentration of up to about 10 ppm.

18. The process of claim 16 wherein prior to or during step (A-6) at least one organic additive is added to said copper-rich stripping solution.

19. The process of claim 13 wherein said aqueous leaching solution comprises sulfuric acid, halide acid or ammonia.

20. The process of claim 13 wherein said extractant in step (A-2) is dissolved in an organic solvent selected from the group consisting of kerosene, benzene, naphthalene, fuel oil and diesel fuel.

21. The process of claim 13 wherein said extractant in step (A-2) comprises at least one compound represented by the formula

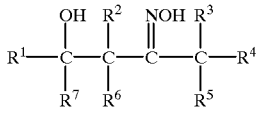

wherein $R^1$, $R^2$, $R^3$, $R^4$, $R^5$, $R^6$ and $R^7$ are independently hydrogen or hydrocarbyl groups.

22. The process of claim 13 wherein said extractant in step (A-2) comprises at least one compound represented by the formula

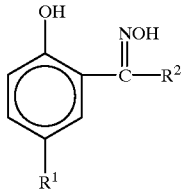

wherein $R^1$ and $R^2$ are independently hydrogen or hydrocarbyl groups.

23. The process of claim 13 wherein said extractant in step (A-2) comprises at least one compound represented by the formula

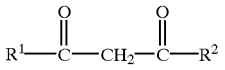

wherein $R^1$ and $R^2$ are independently alkyl groups or aryl groups.

24. The process of claim 13 wherein said extractant in step (A-2) comprises at least one ion exchange resin.

25. The process of claim 13 wherein said stripping solution comprises sulfuric acid.

26. The process of claim 13 wherein during step (A-6) said copper-rich stripping solution has a copper ion concentration in the range of about 25 to about 125 grams per liter and a free sulfuric acid concentration in the range of about 10 to about 300 grams per liter.

27. The process of claim 1 wherein said cutting tool has a sharpened edge of about 40° to about 60° that is defined between a clearance face and a rake face.

28. The process of claim 1 wherein said cutting tool has a composition comprising tungsten carbide.

29. The process of claim 1 wherein during steps (B) and (C), the speed of the surface of said disk is about 5 to about 5000 feet per minute.

30. The process of claim 1 wherein said strip of copper has a thickness in the range of about 0.002 to about 0.5 inch, and a width in the range of about 0.1 to about 1 inch.

31. The process of claim 1 wherein each strand of wire formed during step (D) has a rectangular or square cross section.

32. The process of claim 1 wherein said circular disk has one side that is smooth and one side that is rough, and prior to step (B) said rough side is smoothed.

33. The process of claim 1 wherein said circular disk has one side that is smooth and one side that is rough, and prior to step (B) said rough side is not smoothed.

34. The process of claim 1, wherein the disk's axial dimension is about 0.1 to about 1 inch whereby the cross-sectional dimension of the copper strip is about 0.1 to 1 inch.

35. The process of claim 1, wherein the disk's axial dimension is about 0.1 to about 0.5 inch whereby the cross-sectional dimension of the copper strip is about 0.1 to 0.5 inch.

36. The process of claim 1, wherein the disk's axial dimension is about 0.2 to about 0.3 inch whereby the cross-sectional dimension of the copper strip is about 0.2 to 0.3 inch.

37. The process of claim 1 wherein during step (B), said circular disk rotates in a horizontal plane.

38. The process of claim 1 wherein said circular disk in step (A) has a thickness in the range of about 0.1 to about 1 inch, and a diameter of up to about 60 inches.

39. The process of claim 1, wherein the cross-sectional dimension of the strip of copper corresponding to the disk's axial dimension is the width of the strip of copper and wherein the thickness of the strip of copper is less than its width.

40. The process of claim 39, wherein each of the strands formed during the slitting step has the same thickness as the strip.

41. The process of claim 40, wherein the copper strip has a thickness of about 0.002 to about 0.5 inch.

42. The process of claim 41, wherein the copper strip has a thickness of about 0.008 to about 0.012 inch.

43. The process of claim 40, wherein the copper strip has a thickness of about 0.002 to about 0.10 inch.

44. The process of claim 40, wherein the copper strip has a thickness of about 0.002 to about 0.25 inch.

45. A process for making copper wire, comprising:

(A) electrodepositing a square or rectangular copper plate and cutting said plate to form a circular disk of electrodeposited copper;

(B) rotating said disk about its center axis;

(C) feeding a cutting tool into the peripheral edge of said disk to cause a strip of copper to peel from said disk, the cutting tool moving from the outer peripheral edges of the disk towards the center of the disk; and (D) slitting said strip of copper to form a plurality of stands of copper wire.

46. The process of claim 45 wherein said square or rectangular copper plate has a thickness of about 0.1 to about 1 inch, a length of about 12 to about 60 inches, and a width of about 12 to about 60 inches.

47. A process for making copper wire, comprising:

(A) forming a body of electrodeposited copper having a certain thickness;

(B) peeling a strip of copper from said body, the strip having a width corresponding to the thickness of the body and the strip having a thickness that is less than its width dimension; and (C) slitting said strip of copper to form a plurality of strands of copper wire, each of the strands having the same thickness as the strip.

48. The process of claim 47 wherein the thickness of the body is about 0.1 to about 1 inch whereby the width of the copper strip is about 0.1 to 1 inch.

49. The process of claim 48, wherein the thickness of the copper strip is about 0.008 to about 0.012 inch.

50. The process of claim 47, wherein the thickness of the body is about 0.2 to about 0.3 inch whereby the width of the copper strip is about 0.2 to about 0.3 inch.

51. The process of claim 47, wherein the thickness of the copper strip is about 0.002 to about 0.5 inch.

52. The process of claim 47, wherein the thickness of the copper strip is about 0.002 to about 0.25 inch.

53. The process of claim 47, wherein the thickness of the copper strip is about 0.002 to about 0.10 inch.

54. The process of claim 47 wherein the thickness of the body is about 0.1 to about 0.5 inch whereby the width of the copper strip is about 0.1 to about 0.5 inch.

* * * * *